US007052403B2

(12) United States Patent
Ransil et al.

(10) Patent No.: US 7,052,403 B2
(45) Date of Patent: May 30, 2006

(54) FOLDABLE CHILD SWING

(75) Inventors: Matthew J. Ransil, Stevens, PA (US); Michael L. Longenecker, Ephrata, PA (US); Paul B. Nelson, Elverson, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/702,514

(22) Filed: Nov. 7, 2003

(65) Prior Publication Data

US 2004/0198512 A1 Oct. 7, 2004

Related U.S. Application Data

(63) Continuation-in-part of application No. 10/304,014, filed on Nov. 26, 2002, now Pat. No. 6,645,080.

(51) Int. Cl.
*A63G 9/04* (2006.01)

(52) U.S. Cl. ..... 472/118; 297/16.1

(58) Field of Classification Search ..... 472/118–125; 297/16.1, 273

See application file for complete search history.

(56) References Cited

U.S. PATENT DOCUMENTS

| | | | | |
|---|---|---|---|---|
| 664,322 | A | | 12/1900 | Jacobs |
| 2,398,384 | A | | 4/1946 | Meyers |
| 2,520,377 | A | | 8/1950 | Schrougham |
| 3,256,016 | A | | 6/1966 | Berlin |
| 3,649,074 | A | | 3/1972 | McDonald et al. |
| 3,731,342 | A | | 5/1973 | Cousin |
| 3,883,136 | A | | 5/1975 | Kim |
| 4,022,510 | A | | 5/1977 | Saint |
| 4,240,625 | A | | 12/1980 | Meeker |
| 4,324,432 | A | | 4/1982 | Eldon, III et al. |
| 4,325,578 | A | | 4/1982 | Borucki |
| 4,435,012 | A | | 3/1984 | Kassai |
| 4,697,845 | A | | 10/1987 | Kamman |
| 4,940,229 | A | * | 7/1990 | Foster ..... 472/119 |
| D368,816 | S | | 4/1996 | Mitchell et al. |
| 5,562,548 | A | | 10/1996 | Pinch et al. |
| 5,593,207 | A | | 1/1997 | Turner |
| 5,617,594 | A | | 4/1997 | Chien |
| 5,628,689 | A | * | 5/1997 | Saint et al. ..... 472/118 |
| 5,803,817 | A | | 9/1998 | Stern |
| 5,803,818 | A | | 9/1998 | Tseng |
| 5,915,782 | A | | 6/1999 | Geldbaugh |
| 5,951,108 | A | | 9/1999 | Bauer et al. |
| 5,975,631 | A | | 11/1999 | Fair et al. |
| 5,984,791 | A | | 11/1999 | Fair et al. |
| 6,017,007 | A | * | 1/2000 | Muzzi ..... 248/163.2 |
| 6,022,277 | A | | 2/2000 | Jankowski |
| 6,024,410 | A | | 2/2000 | Yoshida |
| 6,027,409 | A | | 2/2000 | Favorito et al. |

(Continued)

FOREIGN PATENT DOCUMENTS

| | | |
|---|---|---|
| GB | 2 358 793 A | 8/2001 |
| JP | 2001-334855 | 12/2001 |

*Primary Examiner*—Kien Nguyen

(57) ABSTRACT

A child swing comprises a frame including first and second rear legs and first and second housings. First and second fold mechanisms pivotally connect the first and second rear legs to the first and second housings, respectively. The fold mechanisms each include a socket member to receive an upper end of the respective leg. The socket member is pivotally mounted to the respective housing to guide pivoting movement of the respective leg relative to the respective housing. The fold mechanisms each can further include a release lever pivotally mounted to the socket member, and a locking pin connected to the release lever for engagement with the respective housing to facilitation positioning of the respective leg in an in-use position and in a folded position.

38 Claims, 17 Drawing Sheets

U.S. PATENT DOCUMENTS 6,126,236 A * 10/2000 Wu ..... 297/325
6,135,487 A * 10/2000 Flannery et al. ..... 280/642
6,161,898 A 12/2000 Brevi
6,206,462 B1 3/2001 Huang
6,347,830 B1 * 2/2002 Chen ..... 297/16.1
6,348,005 B1 2/2002 Tseng
6,386,986 B1 5/2002 Sonner et al.
6,421,901 B1 * 7/2002 Sitarski et al. ..... 29/401.1
6,427,262 B1 8/2002 Huang
6,520,862 B1 2/2003 Armbruster et al.
6,536,839 B1 3/2003 Liu
6,565,156 B1 5/2003 Yamashita et al.
6,702,685 B1 3/2004 Mahlstedt et al.
6,887,161 B1 5/2005 Mahlstedt et al.

* cited by examiner

FOLDABLE CHILD SWING

This application is a continuation-in-part of U.S. application Ser. No. 10/304,014, filed Nov. 26, 2002 now U.S. Pat. No. 6,645,080, which is incorporated by reference herein in its entirety.

FIELD OF THE INVENTION

This invention relates to a swing. More specifically, this invention relates to a child swing with a fold mechanism.

BACKGROUND OF THE INVENTION

Various types of swings are known in the art. Typically, swings include a support frame, hanger arms pivotably attached to the support frame, and a seat attached to the hanger arms. Electrically powered drive mechanisms are utilized to supply energy to the swing to move the swing seat in a reciprocal motion back and forth.

Some commercially available swings are foldable. Folding the legs of such commercially available swings is not easy or intuitive. The fold mechanisms of these swings can be difficult to operate and/or difficult to locate.

In addition, some commercially available swings include a seat recline feature. The seat back of these swings can be adjusted to different angles relative to the seat bottom so that a parent can position the seat in either an upright position or a reclined position, depending on the need of the child. Older children may prefer the upright position, while younger children with less neck control may prefer the reclined position.

The seat recline mechanism for such swings typically includes a bent wire that travels along a slot in the seat back. The wire arrangement engages the hanger arms on either side of the seat to position the seat back at the appropriate recline angle relative to the seat bottom. Such a wire arrangement, however, is relatively expensive to manufacture and is not readily visible to a parent from the front of the swing.

Foldable swings also are known in the art. The swing seat of such a foldable swing can be adjusted between an open, in-use position and a closed, folded position. When in use, the seat back of the swing seat cannot be adjusted to different recline angles and, accordingly, children who wish to be fully reclined may be uncomfortable in the swing.

SUMMARY OF THE INVENTION

An aspect of the present invention relates to a child swing that comprises a frame including first and second rear legs and first and second housings. First and second fold mechanisms pivotally connect the first and second rear legs to the first and second housings, respectively. The fold mechanisms each include a socket member to receive an upper end of the respective leg. The socket member is pivotally mounted to the respective housing to guide pivoting movement of the respective leg relative to the respective housing. The fold mechanisms each can further include a release lever pivotally mounted to the socket member, and a locking pin connected to the release lever for engagement with the respective housing to facilitation positioning of the respective leg in an in-use position and in a folded position.

Another aspect of the present invention relates to a child swing that comprises a frame including first and second front legs and first and second housings. First and second fold mechanisms pivotally connect the first and second front legs to the first and second housings, respectively. The fold mechanisms each include a socket member to receive an upper end of the respective leg. The socket member is pivotally mounted to the respective housing to guide pivoting movement of the respective leg relative to the respective housing.

A further aspect of the present invention relates to fold mechanism for a child swing, where the child swing includes a frame leg and a housing to which the frame leg is pivotally mounted by the fold mechanism. The fold mechanism comprises a socket member pivotally mounted to the housing and to which the frame leg is mounted. The socket member is configured to guide pivoting movement of the frame leg relative to the housing. The fold mechanism can further comprise a release lever pivotally mounted to the socket member, and a locking pin connected to the release lever for engagement with the housing to facilitate positioning of the frame leg in an in-use position and in a folded position.

Yet another aspect of the present invention relates to a child swing that includes a seat recline feature with more than one in-use position. The child swing comprises a frame, a seat including a seat back, and at least one hanger arm that connects the seat to the frame. The seat back of the swing seat is positionable in a first in-use position, in a second in-use position in which the seat back is adjusted rearward relative to its first in-use position, and in a fold position in which the seat back is adjusted forward relative to its first in-use position. The frame may be movable between an in-use position and a fold position. In this regard, the seat back may be positionable in its first and second in-use positions while the frame is in its in-use position, and the seat back may be positionable in its fold position while the frame is in its fold position.

The swing may further comprise a seat recline mechanism that engages the seat back with the at least one hanger arm. The seat recline mechanism may comprise at least one latch positioned on a side of the seat back for engagement with the at least one hanger arm. The seat back is pivotally connected to the at least one hanger arm by a pivot, and the at least one latch may be located on the side of the seat back at a location spaced from the pivot.

In another aspect of the invention, the at least one hanger arm may comprise a pair of hanger arms, and the at least one latch may comprise a pair of latches, one positioned on each side of the seat back for engagement with a respective one of the hanger arms.

The hanger arms each may include a first rib and a second rib. The first rib may be engageable by the respective latch when the seat back is in the first in-use position, and the second rib may be engageable by the respective latch when the seat back is in the second in-use position.

The frame may include first and second front legs, first and second rear legs, and first and second housings, where the first and second rear legs are pivotally connected to the first and second housings. The frame may further include a handle pivotally connected to the first and second housings.

Still another aspect of the invention relates to a seat recline mechanism for a child swing, in which the mechanism comprises at least one latch positioned on a side of a seat back of the swing, and first and second latch-receiving members positioned on a hanger arm of the swing. The at least one latch is configured to engage the first latch-receiving member to position the seat back in a first in-use position, is configured to engage the second latch-receiving member to position the seat back in a second in-use position in which the seat back is adjusted rearward relative to the first in-use position, and is configured to be disengaged from the hanger arm to position the seat back in a fold position in which the seat back is adjusted forward relative to the first in-use position. The at least one latch may comprise a pair of latches, one positioned on each side of the seat back for engagement with a respective hanger arm of the swing. The first and second latch-receiving members may comprise first and second ribs positioned on the hanger arm.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
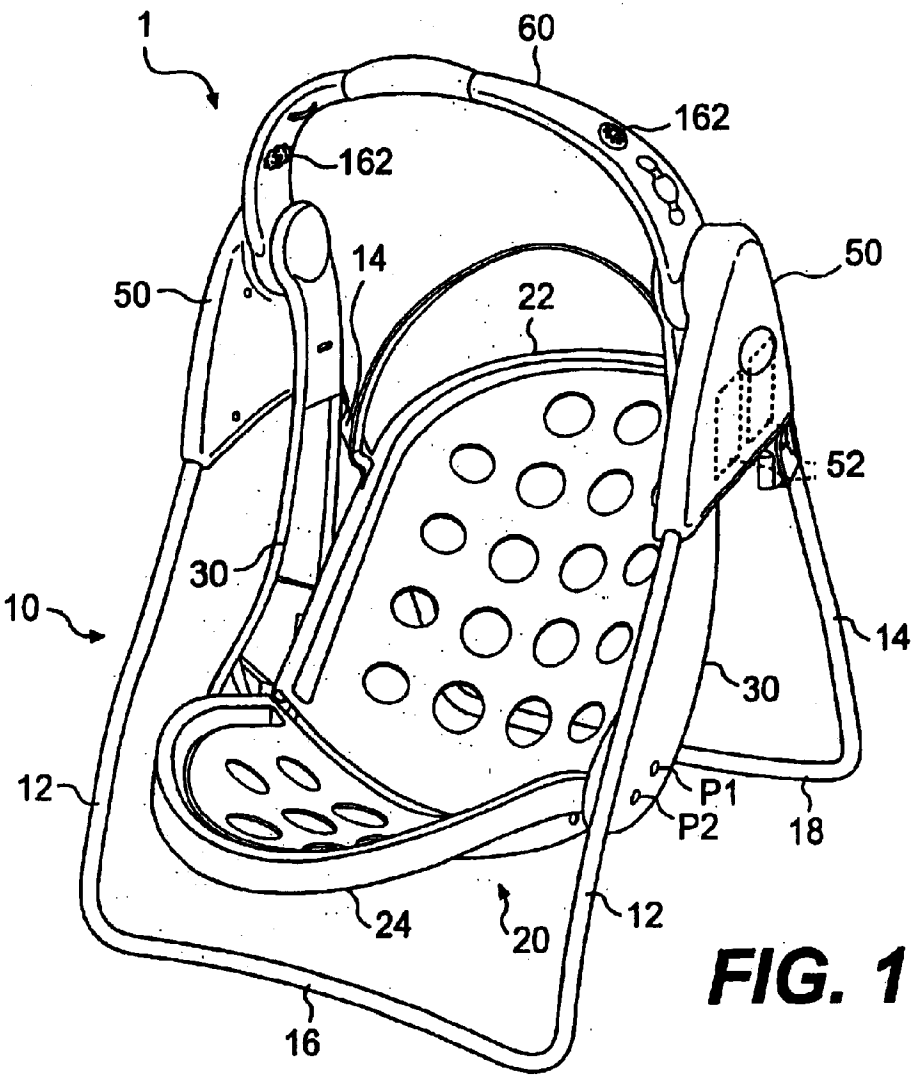
FIG. 1 is a front perspective view of a swing, where the swing handle is in an entertain position, in accordance with the invention.

FIG. 1 illustrates a swing 1 according to an exemplary embodiment of the present invention. The swing 1 has a foldable frame and a reclinable swing seat 20 that can be moved between a fold position, a first, upright in-use position, and a second, reclined in-use position. The swing 1 also includes a handle 60 that can be used to carry the swing. The handle 60 can be rotated between at least two positions. For example, in one embodiment, the handle 60 can be rotated between four positions, including: an open access position during which a child can be seated in the swing, a lift and lock position during which the swing can be carried by the handle, an entertain position during which a child seated in the swing can view lights and/or other play features of the handle, and a storage position during which the handle can be compactly stored when the frame is folded. The number of positions may also be more than four.

The swing 1 generally includes a support frame 10, a seat 20 having a seat back 22 and a seat bottom 24, and pair of hanger arms 30 that connect the seat 20 to the support frame 10. The seat back 22 is pivotally connected to the hanger arms 30 at pivots P1, and the seat bottom 24 is pivotally connected to the hanger arms 30 at pivots P2.

The support frame 10 generally includes front legs 12, rear legs 14, a front cross member 16 extending between the front legs 12, a rear cross member 18 extending between the rear legs 14, and first and second housings 50. In the illustrated embodiment, the front legs 12 of the support frame 10 are fixedly connected to the respective housings 50, and the rear legs 14 of the support frame 10 are pivotally connected to the respective housings 50 to allow the swing 1 to fold, as will be explained below. Alternatively, the front legs can be pivotally connected to the respective housings, and the rear legs can be fixedly connected to the respective housings. In a further embodiment, both the front and rear legs can be pivotally connected to the housings. The fold swing operation will be described below in connection with FIGS. 7–9.

The support frame 10, in addition to supporting the support hangers 30 and ultimately the seat 20, also supports a swing handle 60, which is part of a swing handle assembly. The swing handle 60 is rotationally connected at either end to the housings 50. The operation and structure of the swing handle assembly will be described below in connection with FIGS. 12–21.

The swing 1 also can include a power supply 52 within one of the housings 50 for supplying power to a motor to drive the motion of the swing 1 and/or for supplying power to the swing's electronic devices. The power supply 52 may comprise, for example, a battery holder for holding batteries.

As mentioned above, the swing seat 20 can be moved between a fold position, a first, upright in-use position, and a second, reclined in-use position. More specifically, the seat back 22 of the swing seat 20 is positionable in a first, upright in-use position, in a second, reclined in-use position in which the seat back 22 is adjusted rearward relative to its first in-use position, and in a fold position in which the seat back 22 is adjusted forward relative to its first, upright in-use position. While the frame 10 of the swing 1 is in-use, that is, erect, the seat back 22 can be positioned in its first and second in-use positions, and, when the frame 10 is folded for storage, the seat back 22 can be positioned in its fold position.

Figure 2:
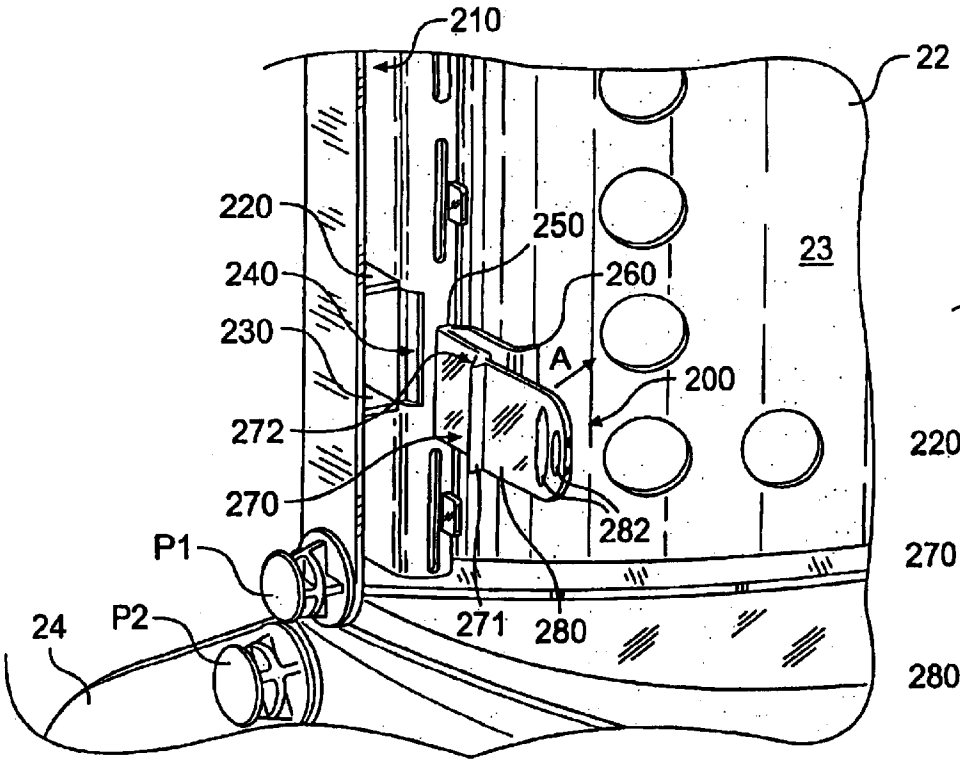
FIG. 2 is a rear perspective, exploded, detail view of the seat back and latch of the swing seat.

The seat recline mechanism will now be described in connection with FIGS. 2–6. The seat recline mechanism includes a latch 200 positioned on each side of the seat back 22 for engagement with the respective hanger arms 30. FIG. 2 is a detail view of the right side of the seat back 22 and the latch 200. Although the figures generally show the structural relationship between the seat 20 and the hanger arms 30 by reference to only one hanger arm 30, it will be understood that, in the illustrated embodiment, the seat-hanger arm relationship on the left and right sides of the swing are mirror images.

The seat back 22 includes a channel 210 molded along at least a portion of the perimeter of the rear surface 23 of the seat back 22. Upper and lower ribs 220, 230 are positioned in the channel 210 for capturing the latch 200 therebetween. The seat back 22 also includes a slot 240 adjacent the ribs 220, 230 for receipt of a portion of the latch 200. As seen in FIG. 2, the latch 200 is spaced from the pivot P1.

Figure 3:
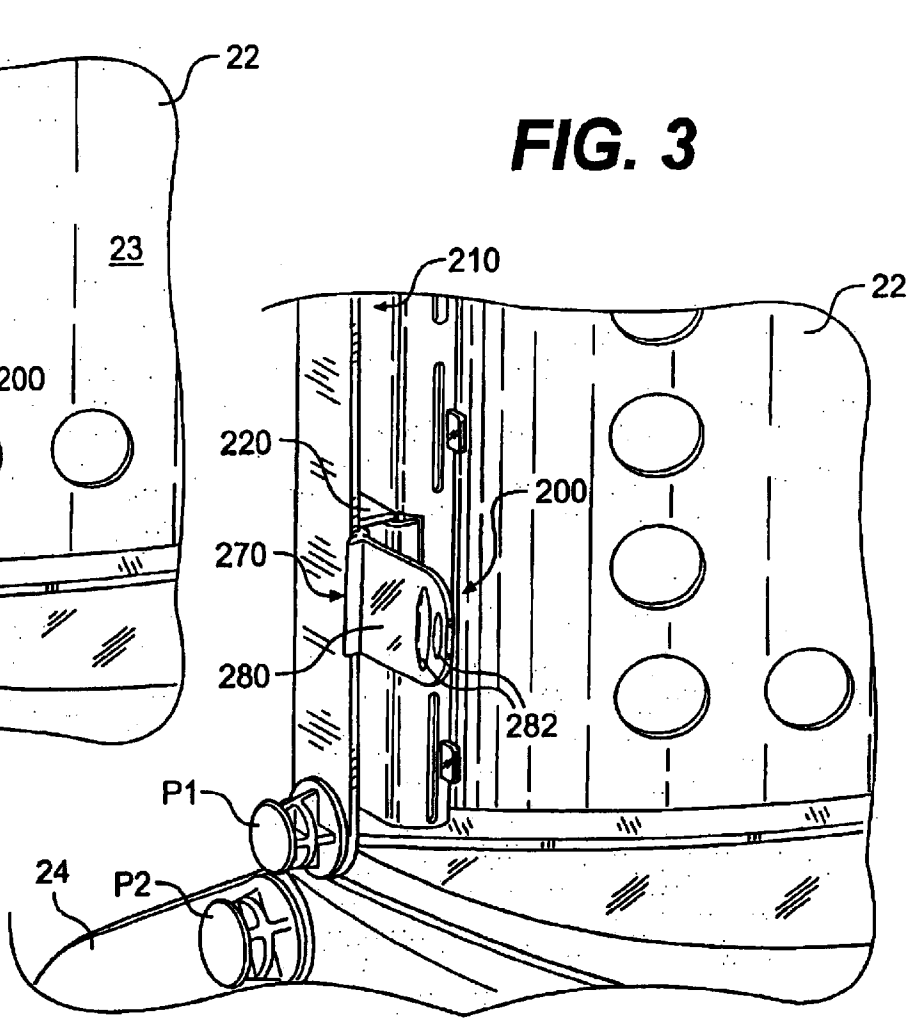
FIG. 3 is a rear perspective, detail view of the seat back and latch of the swing seat.

The latch 200 has a U-shaped segment 250 configured for insertion into the channel 210 between ribs 220, 230, a flange 260 at one end of the U-shaped segment 250, and a locking ridge 270 at the other end of the U-shaped segment 250. The flange 260 is configured for insertion into slot 240 in a snap fit to secure the latch to the seat back 22. FIG. 3 illustrates the latch 200 positioned in the channel 210 of the seat back 22, with flange 260 extending through slot 240. The locking ridge 270 is configured to engage latch-receiving members, such as ribs, on the hanger arms 30 to secure the seat back 22 in a selected in-use position.

The latch 200 also includes a segment 280 with finger bumps 282. A user can press on the finger bumps 282 to flex the latch 200 inwardly, about the U-shaped segment 250, in the direction of arrow A in FIG. 2 to disengage the latch from the hanger arms 30. This segment 280 may be visible to the user to facilitate positioning of the seat back to a desired in-use position.

Figure 4:
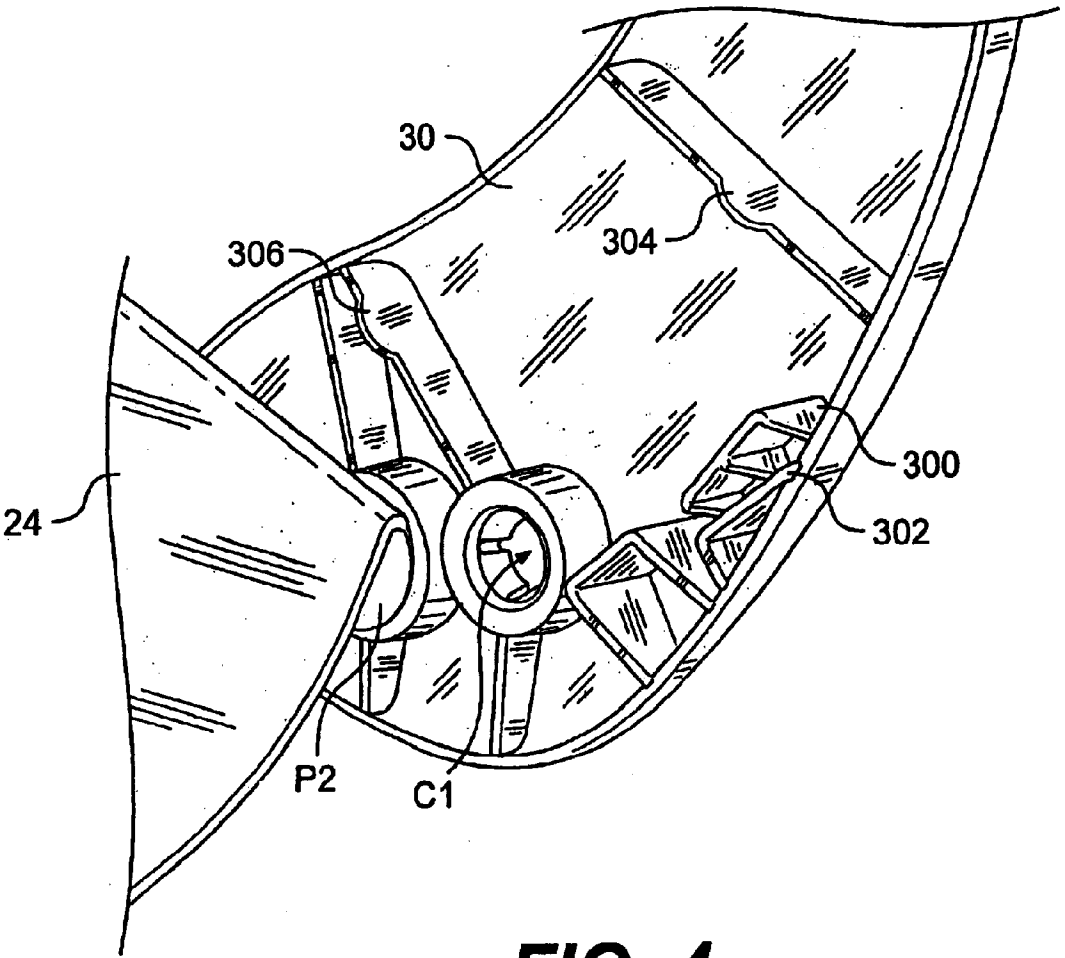
FIG. 4 is a rear perspective, detail view of the inner surface of a hanger arm of the swing.
Figure 6:
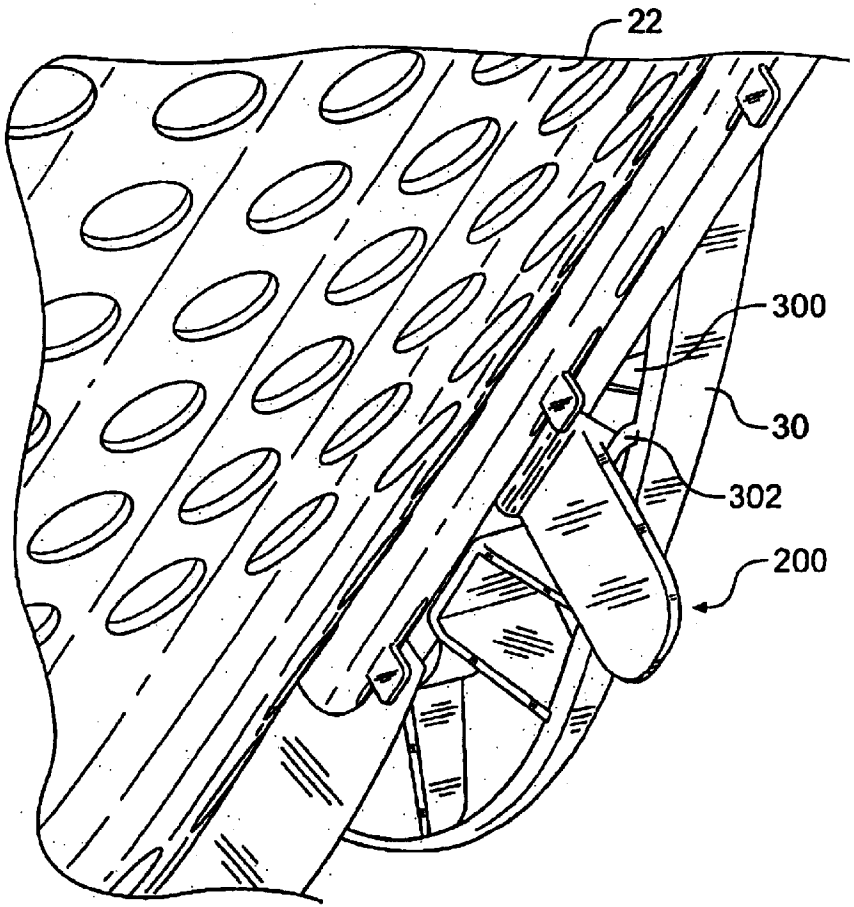
FIG. 6 is a rear perspective, detail view of the hanger arm and seat back, where the seat back is in a second in-use position.
Figure 5:
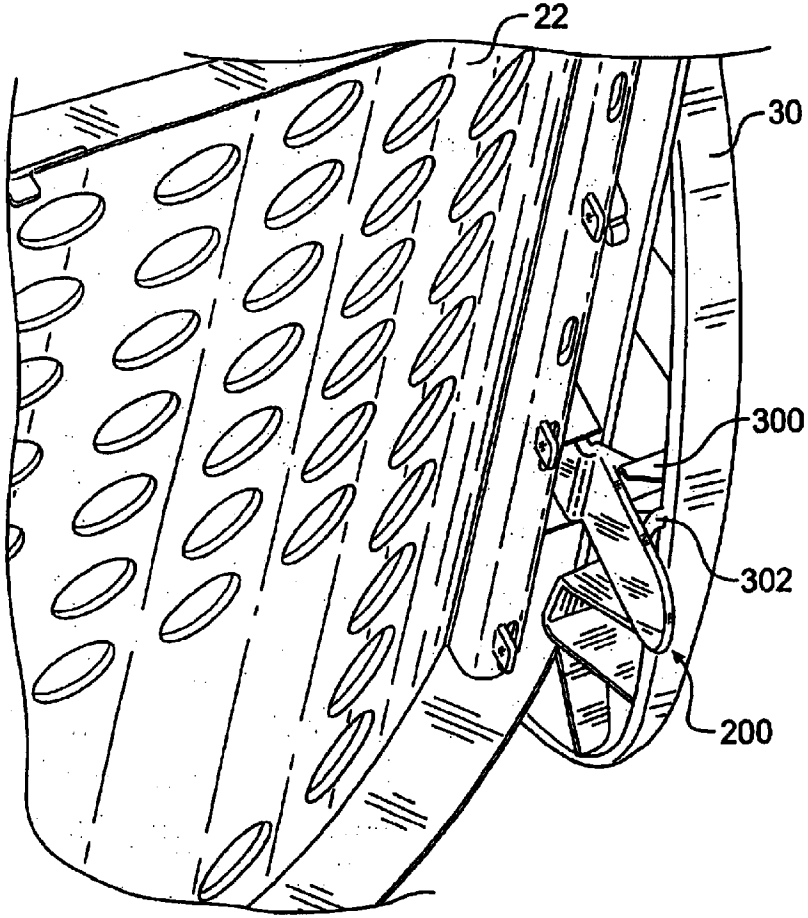
FIG. 5 is a rear perspective, detail view of a hanger arm and seat back, where the seat back is in a first in-use position.

FIG. 4 shows the inner surface of the left-side hanger arm 30 in accordance with the invention, the right-side hanger arm 30 being a mirror image. The hanger arm 30 includes two through holes, one of which is labeled C1, to receive the pivot P1 of the seat back 22 and the pivot P2 of the seat bottom 24, respectively. In other embodiments, the seat back 22 and the seat bottom 24 can share a common pivot, and the hanger arm can include a single hub or single through hole to receive the pivot. The hanger arm 30 also includes first and second ribs 300, 302 corresponding to the first, upright in-use position and the second, reclined in-use position, respectively. To position the seat back 22 in the first, upright in-use position, the locking ridge 270 of each latch 200 is positioned against the first rib 300 of the respective hanger arm 30, as shown in FIG. 5. To position the seat back 22 in the second, reclined in-use position, the locking ridge 270 of each latch 200 is positioned against the second rib 302 of the respective hanger arm 30, as shown in FIG. 6.

As can be seen from FIG. 2, the locking ridge 270 has a flat surface 271 and an angled surface 272. Due to the configuration of the locking ridge 270, the user only needs to actuate the latch 200 to move the seat back 22 in a rearward direction, for example, from the upright in-use position to the reclined in-use position. The user need not actuate the latch 200 to move the seat back 22 in a forward direction, for example, from the reclined in-use position to the upright in-use position. When moving the seat back 22 forward from the reclined in-use position toward the upright in-use position, the user can grip the seat back 22 and pivot it forward, which causes the angled surface 272 to ride over the first rib 300. The latch 200 flexes inward until it passes the rib 300 and then restores to its at-rest configuration. At this point, the user can release the seat back 22 to allow the flat surface 271 to rest on the first rib 300. The seat back 22 can be moved from the upright in-use position to the fold position in the same manner, that is, by simply gripping the seat back 22 and pivoting it forward.

In addition to ribs 300, 302, each hanger arm 30 can include a rib 304 on its inner surface, forward of rib 302, to maintain the seat back 22 in the fold position. The rib 304 has a detent so that, when folded, the side of the seat back 22 comes into contact with the detent in a friction fit and is maintained in the fold position until the user pushes the seat back 22 rearward, away from the rib 304. Similarly, the hanger arms 30 each can include a rib 306 with a detent for engagement with a side of the seat bottom 24 to maintain the seat bottom 24 in a fold position when pivoted upwardly and rearwardly, toward the seat back 22.

Although only two in-use positions are shown in the figures, it will be understood that the hanger arms 30 can include additional ribs representative of additional in-use positions. Further, although the figures show the seat 20 suspended from a pair of hanger arms 30, the present invention envisions a swing having a single hanger arm to suspend the seat.

The latches 200 can be integrally molded as a unitary body with the seat back 22, or they can be fabricated separately from the seat back 22 and later releasably attached to the seat back 22 as shown in FIG. 2. When fabricated separately, the latches 200 can have a different color than the seat back 22 to make them more visible to the user. In addition, the latches 200 can be fabricated from any suitable material, including plastic (such as acetal), steel, and aluminum. When the latch 200 is fabricated from a relatively rigid material, such as a metal or metal alloy, as opposed to a flexible plastic, the latching force achieved by deformation and restoration of the plastic latch material can be accomplished by a spring appropriately located relative to the metal latch 200 and the channel 210.

Figure 7:
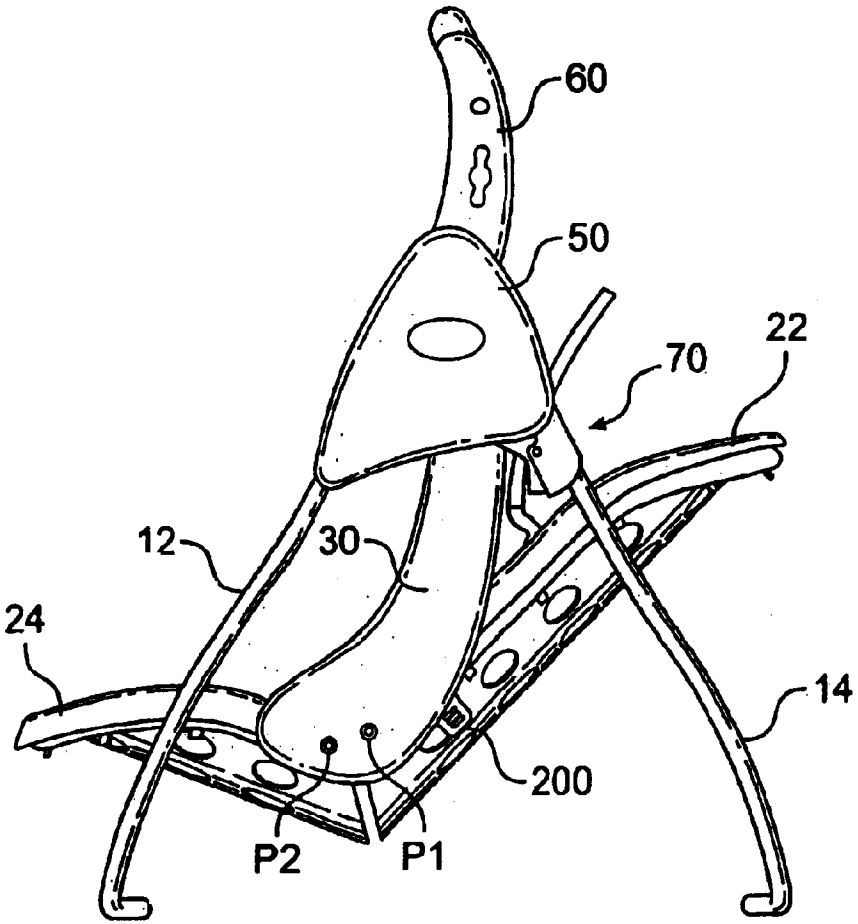
FIG. 7 is a side view of the swing in the first in-use position.
Figure 9:
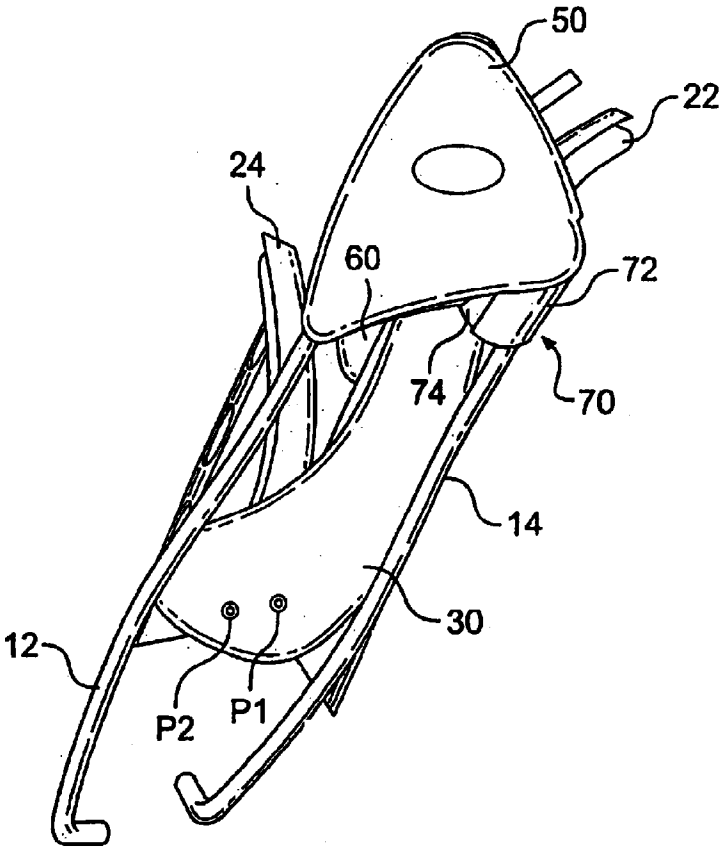
FIG. 9 is a side view of the swing in a fully folded position.
Figure 8:
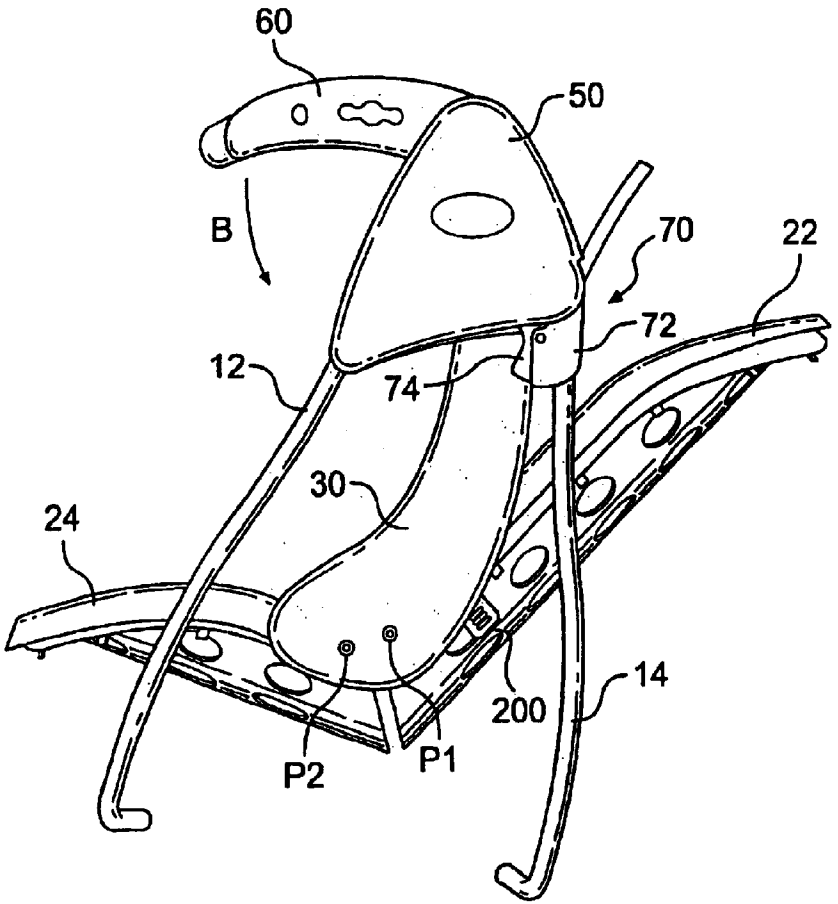
FIG. 8 is a side view of the swing in an intermediate fold position.

The swing fold operation will now be described in connection with FIGS. 7–9. FIG. 7 shows the swing in an in-use position, the seat back 22 in its first, reclined in-use position, and the swing handle 60 in its lift and lock position. A rear leg fold mechanism 70 is mounted to each rear leg 14 adjacent each housing 50. To fold the swing 1, the rear leg fold mechanisms 70 are actuated by the user so that the rear legs 14 can pivot relative to the housings 50 toward the front legs 12.

Figure 10:
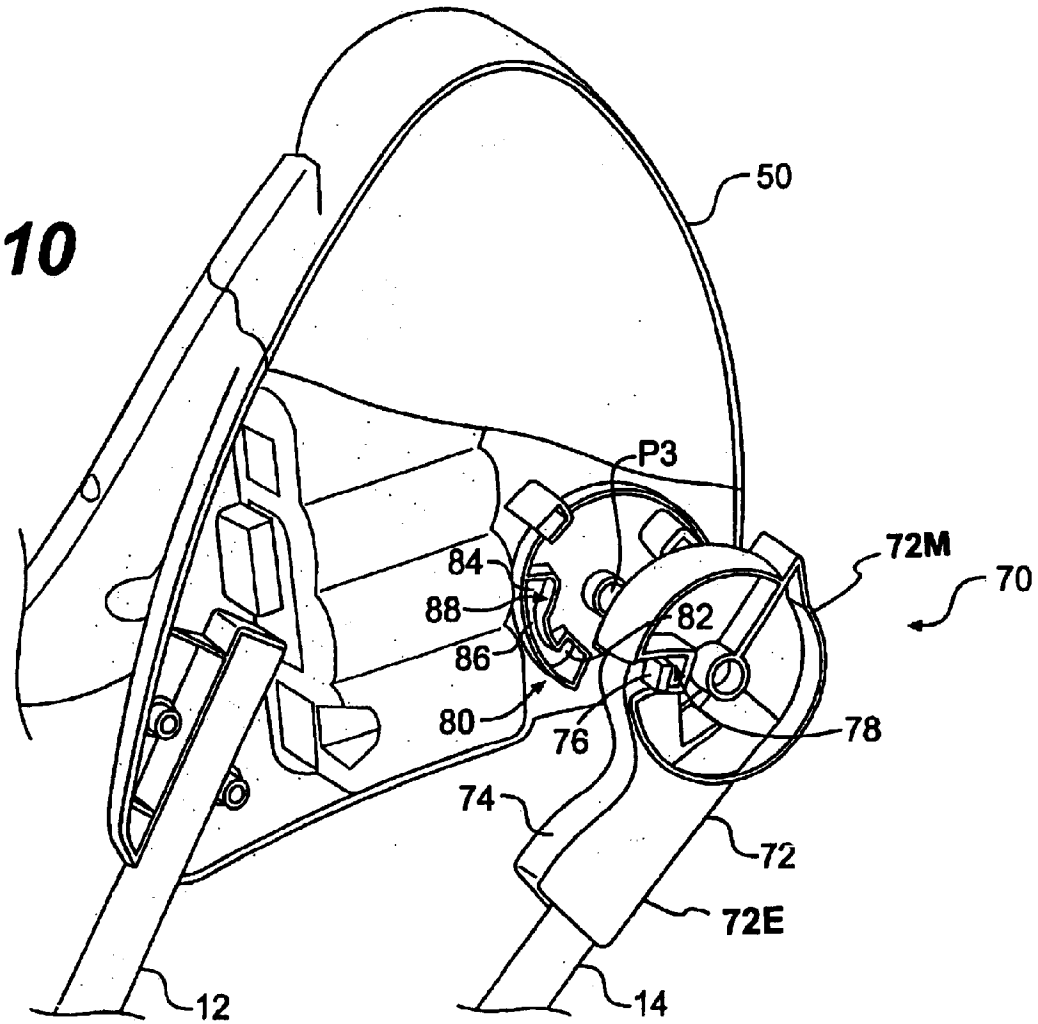
FIG. 10 is an exploded, detail view of the rear leg fold mechanism.
Figure 10A:
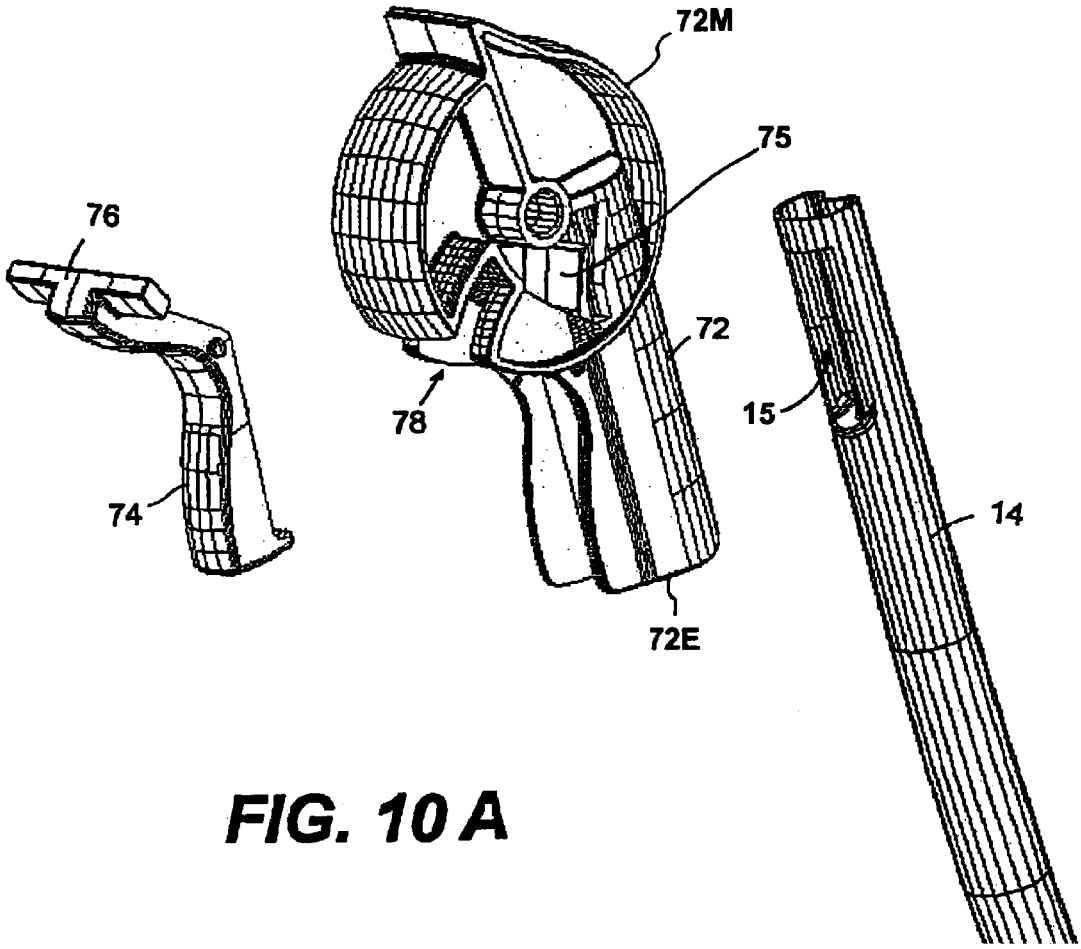
FIG. 10A is an exploded, perspective view of the leg socket member and the release lever of the rear leg fold mechanism.
Figure 11A:
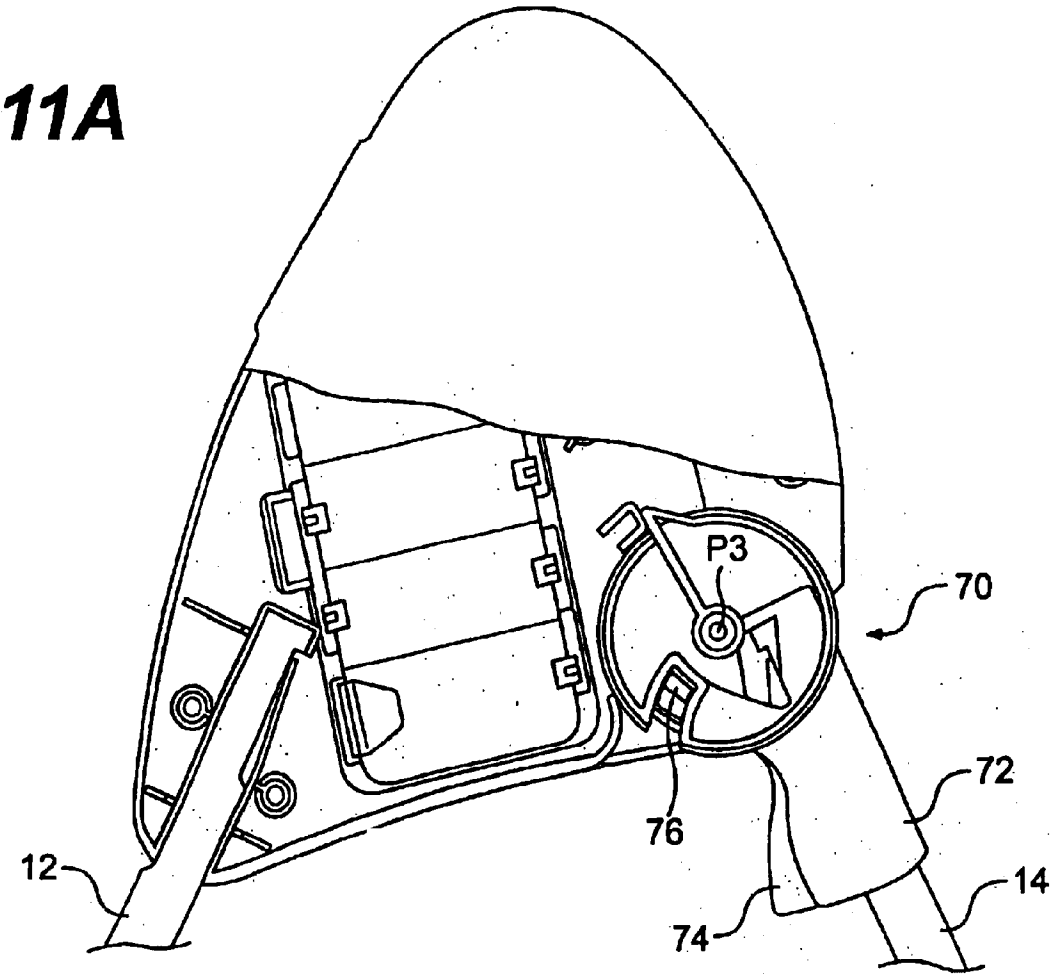
FIG. 11A is a detail view of the rear leg fold mechanism in a locked, in-use position.
Figure 11B:
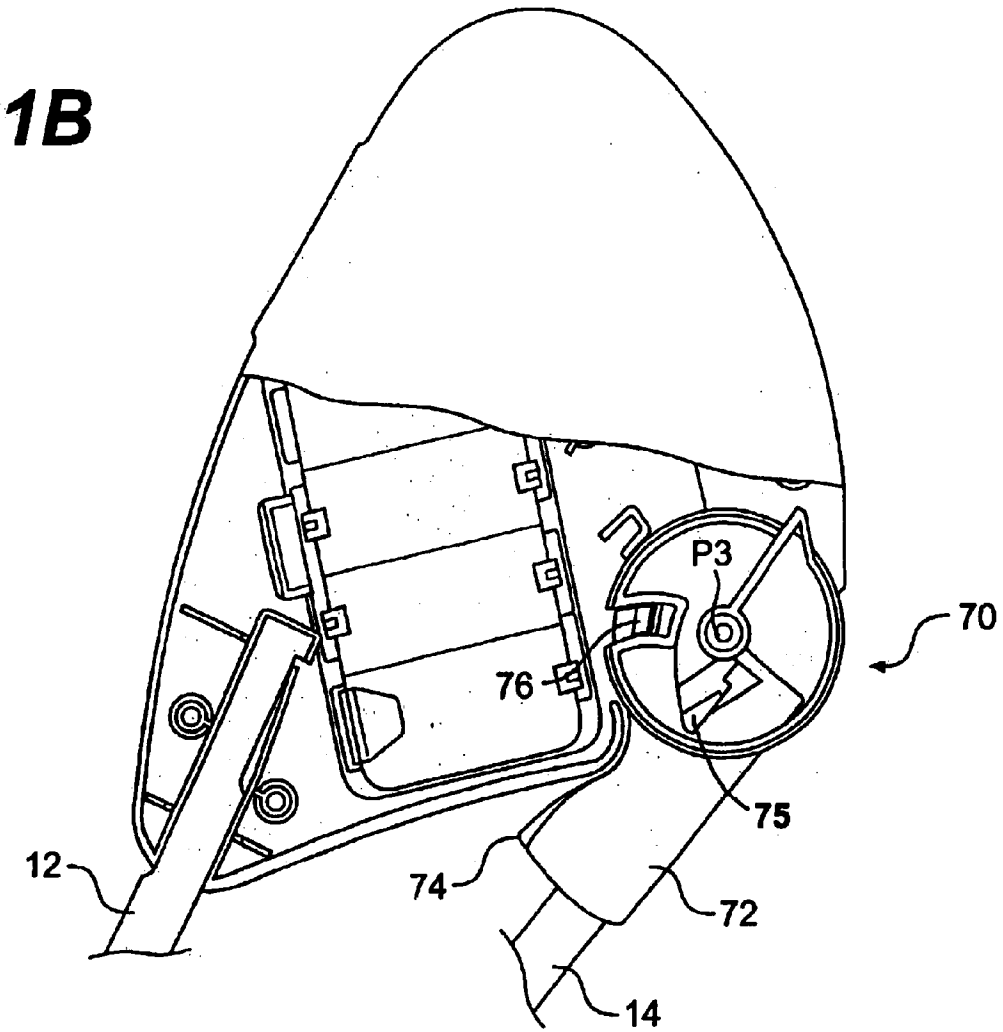
FIG. 11B is a detail view of the rear leg fold mechanism in a fold position.

FIGS. 10, 10A, 11A, and 11B illustrate the rear leg fold mechanism 70 in more detail. The rear leg fold mechanism 70 generally includes a leg socket member 72 to which the rear leg is mounted, a release lever 74, and a locking pin 76 connected to the release lever 74. The socket member 72 includes a tab 75 that engages a slot 15 in the leg 14 to lock the leg 14 to the socket member 72. The integration of this tab 75 eliminates the need for a snap button to hold the leg 14 in place. The leg The socket member 72 is rotationally mounted to the respective housing 50 about pivot P3 and rotates with the rear leg 14 between the in-use position and the fold position. The socket member 72 generally includes a main body portion 72M that is pivotally mounted to the housing and an extension 72E, extending from the main body portion 72M, that receives the respective leg 14. The release lever 74 is pivotally connected to the socket member 72. The locking pin 76 of the release lever 74 is configured to be captured in slots 78, 80 in the socket member 72 and the housing 50, respectively. The slot 78 in the socket member 72 has a slight arc to allow the pin 76 to move radially outward (when the lever 74 is squeezed) and radially inward (when the lever 74 is released). The slot 80 in the housing 50 includes a lock area 82, a folded detent area 84, and a travel area 86 between the two. Although FIGS. 10, 11A, and 11B show only the inner surface of one side of the housing 50, and its slot 80, it will be understood that the inner surface of the opposite side of the housing 50 has a slot, which is the mirror image of slot 80, and the locking pin 76 is captured in the slots on both inner surfaces of the housing. In addition, as shown in FIG. 10A, the locking pin 76 of the illustrated embodiment is formed as part of the release lever 74; however, it will be understood that the locking pin 76 can be molded separately from, and then connected by a suitable fastener to, the release lever 74.

When the leg 14 is in the in-use position, as shown in FIG. 11A, the lever 74 is in its release position, and the pin 76 is positioned in the lower, lock area 82. In this locked position, the pin 76 is in a shear condition between the sidewalls of slot 78 and the sidewalls of slot 80. The pin 76 and the socket 72 are prevented from rotating around the socket's axis of rotation P3 by the pin's engagement in lock area 82, and, hence, the leg 14 is prevented from folding. The lever 74 can include a spring (not shown) that biases the lever 74 to the release position shown in FIG. 11A. The spring can be a separate piece from the lever 74, or it can be integrated into the design of the lever 74, which may be possible in an acetal lever, for example. In addition, the lever 74 can be made of a strong material, such as nylon, to resist the shear forces. Further, the slot 78 in the socket 72 and the slot 80 in the housing 50 preferably reside close to each other in the assembled fold mechanism so as to minimize bending forces on the locking pin 76.

To rotate the leg 14 from its in-use position to its folded position, the lever 74 is squeezed, and the pin 76 moves into the travel area 86 in the housing slot 80. When the pin 76 is in the travel area 86, the lever 74 and the socket 72 can pivot relative to the housing 50. The pin 76 rides along the track-like, travel area 86 as the rear leg 14 is pivoted to the fold position. FIG. 8 shows the rear legs 14 in a partially pivoted position. In this position, the locking pin 76 is located in travel area 86. When the rear leg 14 is completely folded, as shown in FIG. 11B, the pin 76 can move into the folded detent area 84 to hold the leg 14 in place. This area 84 has a lead out angled surface 88 that creates a detent or soft lock. Because there is no positive lock in this area 84, the legs 14 can be moved from the folded position to the in-use position without squeezing the lever 74. That is, the angled surface 88 allows a user to open the swing frame without squeezing the lever 74, but keeps the legs 14 in the folded position until they are forced open. The degree of the angled surface 88 will determine the amount of force needed to move the legs 14 to the in-use position.

In one alternative embodiment, the lever 74 and the slot 80 in the housing 50 may be configured to require that the lever 74 be unlocked to move the leg 14 from the folded position to the in-use position. In another alternative embodiment, the rear leg fold mechanism 70 may be configured so that, rather than including a soft lock or a positive lock in the folded position, the mechanism 70 does not lock at all in the closed position.

The position and the method of activating the lever 74 facilitate folding of the leg 14. The lever 74 is located at an upper end of the leg 14, along a front surface of the leg 14, so that a user standing behind the swing can easily grip the lever 74 and fold the leg 14. The same squeezing motion used to grab the legs 14 of the swing will compress the lever 74 and move the pin 76 out of the lock area 82. The lever 74 rotates with the socket 72, so the likelihood that a user's fingers will get pinched between the parts of the fold mechanism 70 is minimal. The lever 74 is readily visible, as can be seen in FIGS. 7–9, and can be manufactured in a contrasting color relative to the socket 72, the leg 14, and the housing 50 to communicate its function clearly to the user.

In addition, because the fold mechanism 70 occupies a relatively small area within the housing 50, the housing 50 itself can be relatively small in size. In this regard, the main body portion 72M of the socket 72, which is generally circular in shape, is positioned in a lower, rear location of the housing 50, and the upper end of the leg 14 extends into this socket 72. As compared to conventional swings, in which the upper end of the leg is connected directly to the housing and, hence, in which the housing must accommodate the pivoting of the leg from the in-use position to the fold position, the housing 50 of swing 1 can be much more compact.

Further, the fold mechanism 70 can be designed so that the socket 72 can be rotated to a sufficient degree to enable the rear legs 14 to contact the front legs 12 in a very compact fold. Additionally, although the leg 14 and the socket member 72 are formed as two separate components in the illustrated embodiment, it is conceivable that the leg 14 and the socket member 72 could be formed as a unitary construction. For example, the leg 14 and the socket member 72 could be made of a plastic material as a single die-cast component.

In another alternative embodiment, the lever 74 can be replaced with a side button release mounted to the side of the socket member. The side button release can be configured with two sets of teeth, one set to selectively engage mating teeth in the socket member and the other set to selectively engage teeth in the housing. Engagement of the teeth in this alternative embodiment controls pivoting of the socket member, and hence the leg of the swing frame, relative to the housing.

Although the figures show fold mechanisms associated with the rear legs, it is envisioned that, in an alternative swing arrangement, the fold mechanisms could be associated with the front legs.

In addition to the pivoting of the rear legs 14, the swing handle 60 is pivoted during the fold operation. The swing handle 60 is pivoted from an in-use position (one of the open access position, the lift and lock position, and the entertain position) to the storage position, in the direction of arrow B in FIG. 8. The swing handle 60 can be moved to the storage position either before or after folding of the rear legs 14.

Once the swing handle 60 is in the storage position, the seat back 22 and the seat bottom 24 are pivoted to their fold positions. That is, the seat back 22 and the seat bottom 24 are pivoted toward each other until the back and bottom 22, 24 frictionally engage the detents of the respective ribs 304, 306 on the inner surface of the hanger arms 30. The swing handle 60 nests between the seat back 22 and bottom 24 when all three structures are folded. FIG. 9 illustrates the swing 1 in its fully folded position.

If the user wants to carry the folded swing 1, the user can maintain the swing handle 60 in the lift and lock position shown in FIG. 7 and fold the remaining swing structures, including the rear legs 14, the seat back 22, and the seat bottom 24. In this regard, the swing handle assembly operates independently of the remaining fold structures.

Figure 12:
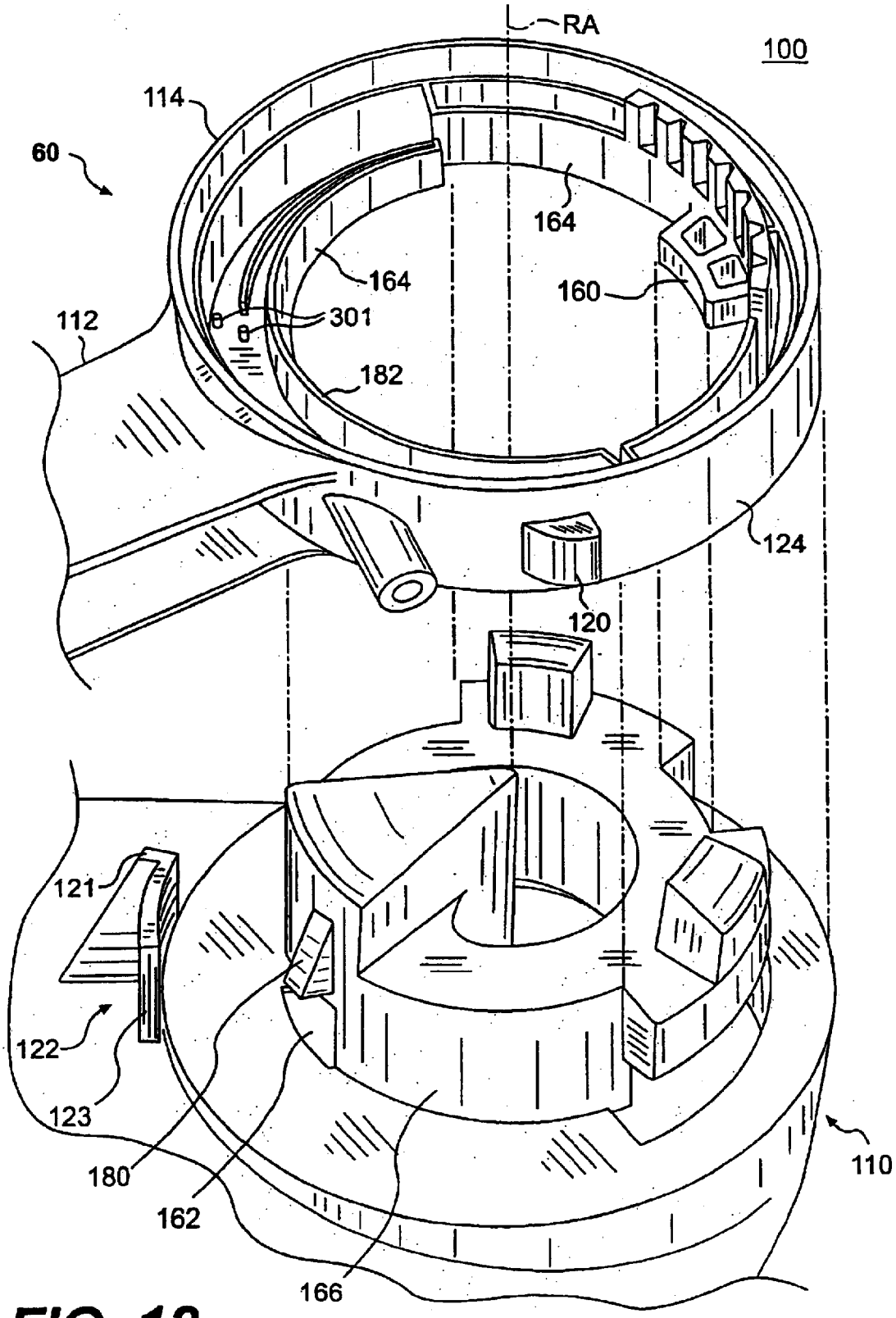
FIG. 12 is an exploded, detail view of a swing handle assembly in accordance with the invention.

FIG. 12 illustrates a swing handle assembly 100 according to an exemplary embodiment of the invention. Such a swing handle assembly 100 is present at each end of the swing handle 60 to mount the swing handle 60 to the frame 10 (shown in FIG. 1). The swing handle assembly 100 includes an end of the swing handle 60 and a handle support structure 110. The handle support structure 110 is positioned within a respective housing 50 (shown in FIG. 1), and it may be integrally molded with the housing 50 or may be attachable to the housing 50. The swing handle 60 is rotationally coupled to the handle support structure 110 such that the swing handle 60 may rotate about a handle rotational axis RA between at least two positions. In addition, the swing handle 60 may include a number of electronic devices 162, as shown in FIG. 1.

The swing handle 60 may comprise a handle portion 112 and a support interface portion 114. The support interface portion 114 is the portion of the swing handle 60 that is attached to the handle support structure 110. The support interface portion 114 is positioned within the respective housing 50 (shown in FIG. 1).

Figure 13:
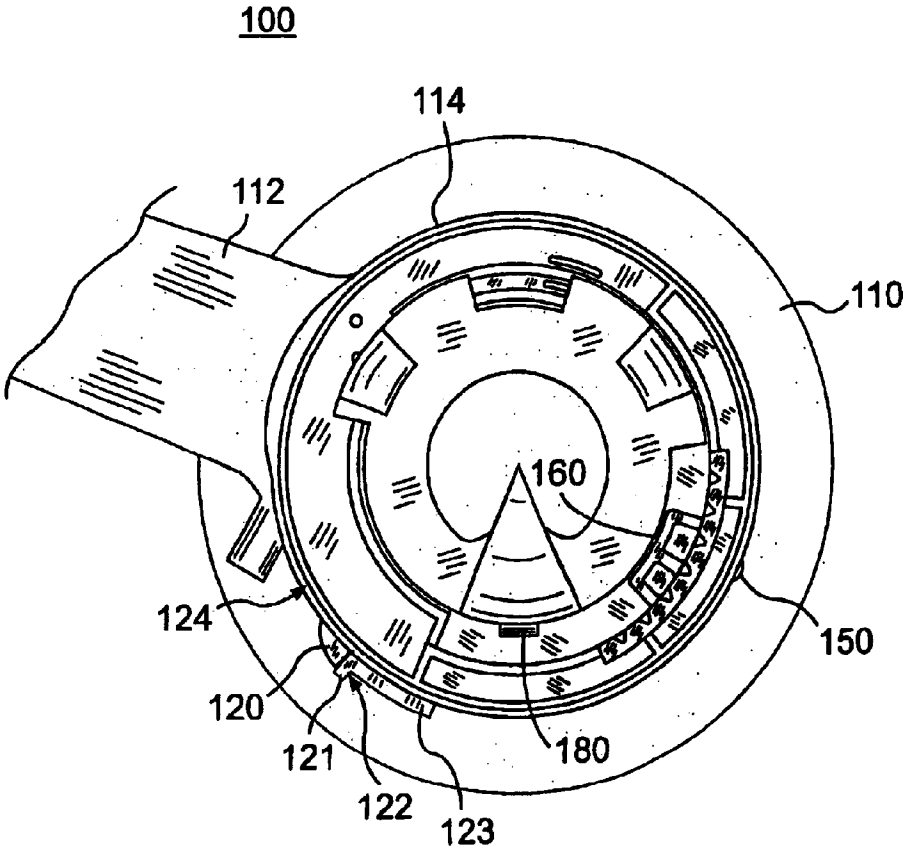
FIG. 13 is a detail view of the right-side, swing handle assembly, where the swing handle is rotated to an open access position.

FIG. 13 illustrates the swing handle 60 rotated relative to the handle support structure 110 so that the swing handle 60 is in an open access position. In this position, a central portion of the swing handle 60, which includes the central portion of the handle portion 112, is arranged rearward of the rotational axis of the handle 60. In this application forward of the rotational axis is toward a front of the swing 1 and rearward of the rotational axis is toward the rear of the swing 1.

Figure 14:
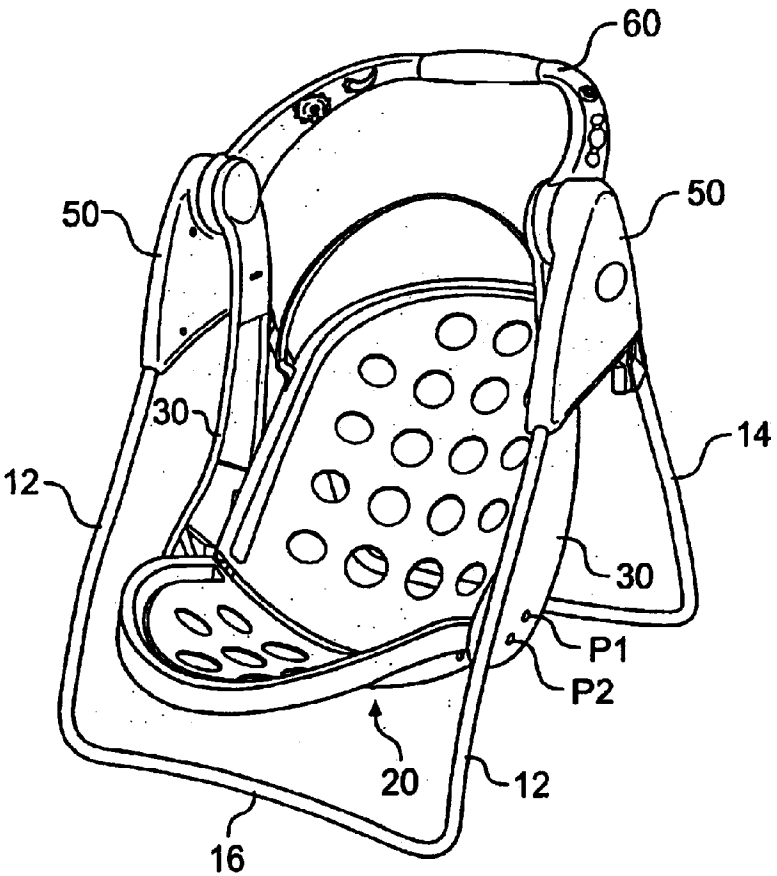
FIG. 14 is a front perspective view of the swing, where the swing handle is in the open access position.

In this open access position, access to the seat 20 is easily facilitated because the swing handle 60 is out of the way relative to the seat 20, as illustrated in FIG. 14. A child may be easily placed within the seat 20 while the swing handle 60 is rotated rearward. In this open access position, the swing handle 60 is stopped from any further rearward rotation relative to the handle support structure 110 and the frame 10. The swing handle 60 is stopped relative to the support structure 110 when a handle stop 120 on the handle 60 meets a support stop 122 on the handle support structure 110.

Referring to FIG. 13, the handle stop 120 is located on an outer peripheral wall 124 of the support interface portion 114. The handle stop 120 may be shaped, for example, as a protrusion with a flat edge facing the support stop 122 when in contact with the support stop 122. The support stop 122 may be shaped, for example, as a protrusion with a flat edge facing the handle stop 120 when in contact with the handle stop 120. In particular, the support stop 122 may be generally L-shaped with a radial rib 121 of the L facing the handle stop 120. The radial rib 120 extends radially from the axis of rotation. The radial rib 121 contacts the handle stop 120 when the handle stop 120 meets the support stop 122. The support stop 122 may also include a circumferential rib 123 extending in a circumferential direction relative to the axis of rotation. In this respect, the support stop 122 has a dual function: to facilitate positioning of the swing handle 60 in the open access position, as explained above, and to facilitate positioning of the swing handle 60 in the entertain position, as will be explained below.

Figure 15:
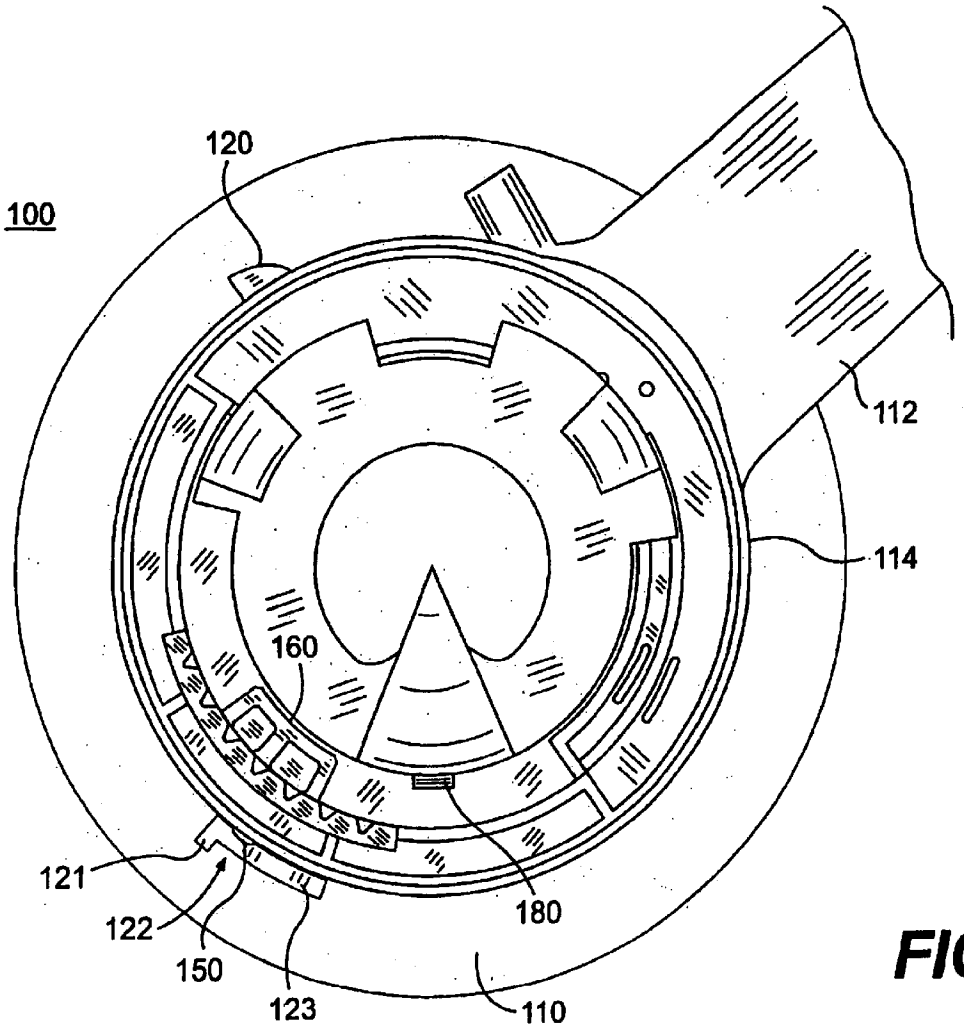
FIG. 15 is a detail view of the right-side, swing handle assembly, where the swing handle is rotated to an entertain position.

Rotation of the swing handle 60 relative to the handle support structure 110 to the entertain position is now described with reference to FIGS. 1, 12, and 15. FIG. 15 illustrates the swing handle 60 rotated relative to the handle support structure 110 so that the swing handle 60 is in an entertain position. In this position, a central portion of the swing handle 60 is arranged forward of the rotational axis of the swing handle 60, when the swing handle 60 is arranged as part of the swing. The swing handle 60 and handle support structure 110 are configured so that, when the swing handle 60 is in this entertain position, the central portion of the swing handle 60 is positioned above and/or in front of a child seated in the swing. Thus, the child would be able to easily view the swing handle 60 and any toys and/or electronic stimuli associated with the handle 60. In this regard, the swing handle 60 may include features to entertain the child. As described further below, the swing handle may include electronic devices 162 (shown in FIG. 1) to provide lights and/or sounds for entertainment.

To maintain the swing handle 60 in the entertain position, the support interface portion 114 includes a detent mechanism that frictionally resists rotational motion by the swing handle 60 in a forward or rearward direction relative to the handle support structure 110 and the swing frame 10. The detent mechanism may comprise, for example, one or more detents on one of the support interface portion 114 of the swing handle 60 and the handle support structure 110. The other of the support interface portion 114 and the handle support structure 110 includes a protrusion, as part of the detent mechanism, arranged such that when the swing handle 60 is rotated in a first direction relative to the handle support structure 110 and the detent and the protrusion meet, the detent frictionally resists rotational motion by the swing handle 60 in the first direction or in a direction opposite to the first direction.

FIG. 15 illustrates an example where the detent 150 is on the support interface portion 114 of the swing handle 60. In this case, the support stop 122 may serve as the protrusion that frictionally resists the detent 150 when the detent 150 and the support stop 122 meet. Alternatively, the protrusion may be other than the support stop 122.

The support stop 122 may be generally L-shaped, as described above with respect to FIGS. 12 and 13. The radial rib 121 of the L extends radially from the center of rotation and acts to stop the handle stop 124, as explained with respect to the open access position of FIG. 13. The radial rib 121 may be angled such that its radially distance from the rotation axis increases along the rotation axis. The circumferential rib 123 of the L extends circumferentially and engages the detent 150 to provide frictional engagement between the support stop 122 and the detent 150 as the detent 150 moves along the support stop 122. The circumferential rib 123 and the height of the detent 150 are set to provide sufficient resistance to rotation to hold the swing handle 60 in the entertain position, but not so much resistance as to make it difficult to rotate the handle out of the entertain position. FIG. 1 illustrates the swing with the handle 60 in the entertain position.

Figure 17:
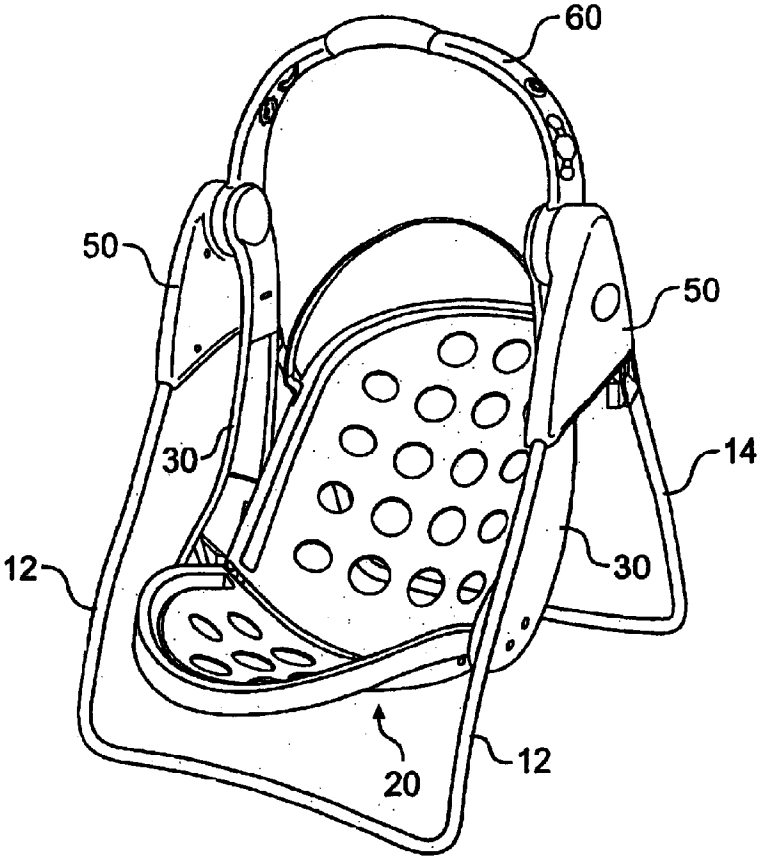
FIG. 17 is a front perspective view of the swing, where the swing handle is in the lift position.
Figure 16:
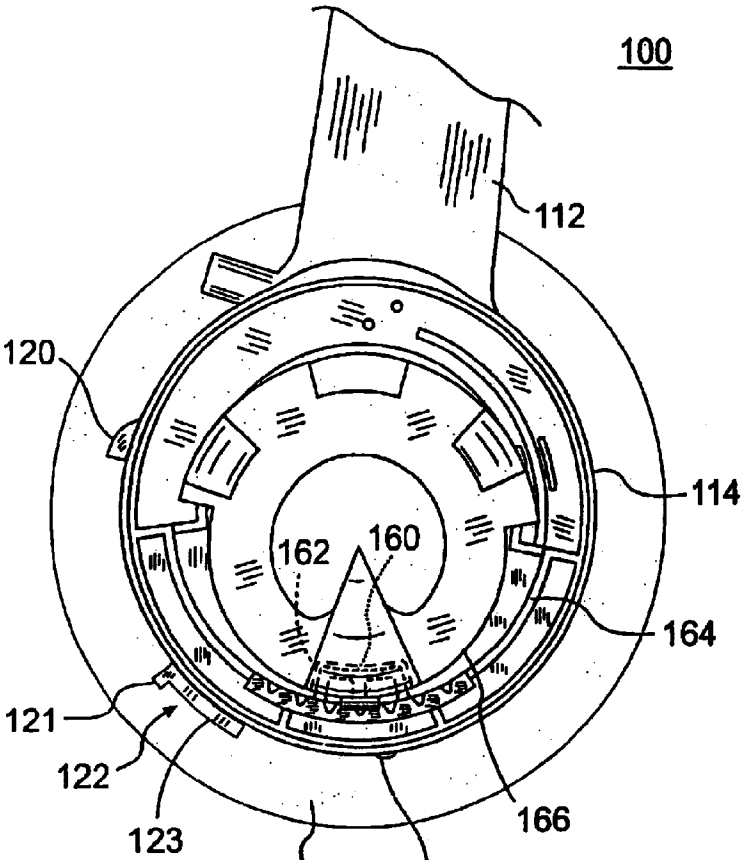
FIG. 16 is a detail view of the right-side, swing handle assembly, where the swing handle is rotated to a lift position.

Rotation of the swing handle 60 relative to the handle support structure 110 to the lift position is now described with respect to FIGS. 12, 16, and 17. FIG. 17 illustrates the swing handle 60 rotated relative to the handle support structure 110 so that the swing handle 60 is in the lift position. In this position, a central portion of the swing handle 60 is arranged generally above the rotational axis of the swing handle 60, when the swing handle is arranged as part of the swing. In this lift position, the swing handle 60 is locked relative to the handle support structure 110 and frame 10. The swing 1 may be lifted by grasping the swing handle 60 and lifting. Because the rotational motion of the swing handle 60 is locked relative to the swing frame 10, the swing 1 may be more easily carried without awkwardness otherwise caused by freely swinging motion of the swing frame 10 relative to the swing handle 60.

The swing handle may be locked relative to the swing frame 10 and handle support structure 110 by means of a protrusion and matching recess. For example, one of the support interface portion 114 of the swing handle 60 and the handle support structure 110 may include a protrusion, and the other of the support interface portion 114 and the handle support structure 110 may include a recess matched to the protrusion such that, when the protrusion is within the recess, the swing handle 60 is locked relative to the handle support structure 110. The locking mechanism of the protrusion and recess may also incorporate a user-activated lock.

FIGS. 12 and 16 illustrate an example where the protrusion 160 is on an inner peripheral wall 164 of the support interface portion 114 of the swing handle 60, and the recess 162 is on an outer peripheral wall 166 of the handle support structure 110. When the swing handle 60 is rotated such that the protrusion 160 lines up with recess 162, the handle 60 may be grasped and lifted so that the protrusion 160 enters the recess 162, and further rotational motion of the swing handle 60 relative to the handle support structure 110, in either rotational direction, is prevented. The locking of the handle 60 relative to the handle support structure 110 may be released by lowering the handle 60 (such as by pushing on the handle 60) relative to the handle support structure 110 to disengage the protrusion 160 from the recess 162. FIG. 17 illustrates the swing with the handle 60 in the lift position.

The lift and lock mechanism described above with the matching protrusion and recess provides a number of advantages. Locking action is transparent to the user with no secondary action required. Moreover, the design uses few moving parts and is easy to assemble. Further, cost effective materials can be used to achieve the desired function.

Figure 21:
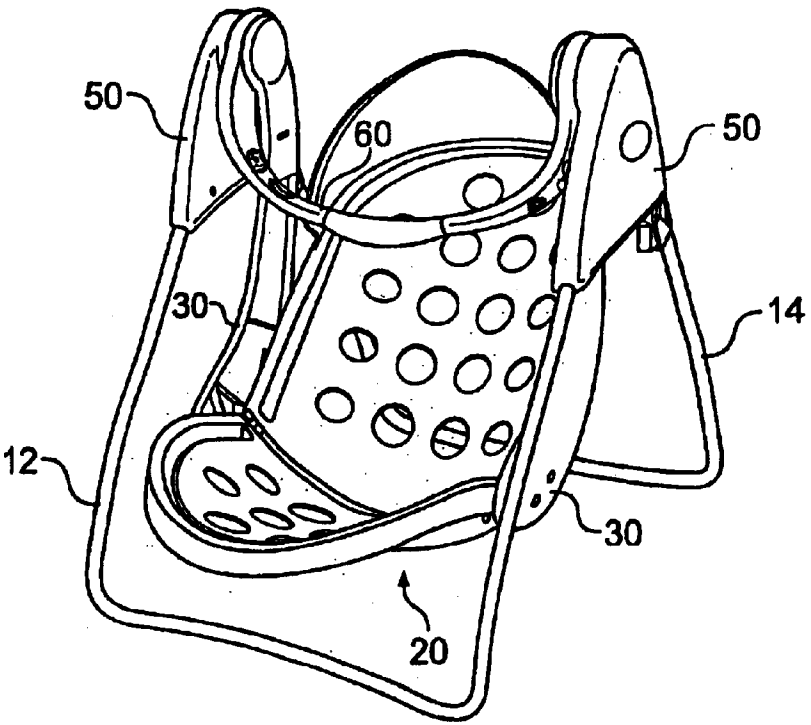
FIG. 21 is a front perspective view of the swing, where the swing handle is rotated to the storage position.
Figure 20:
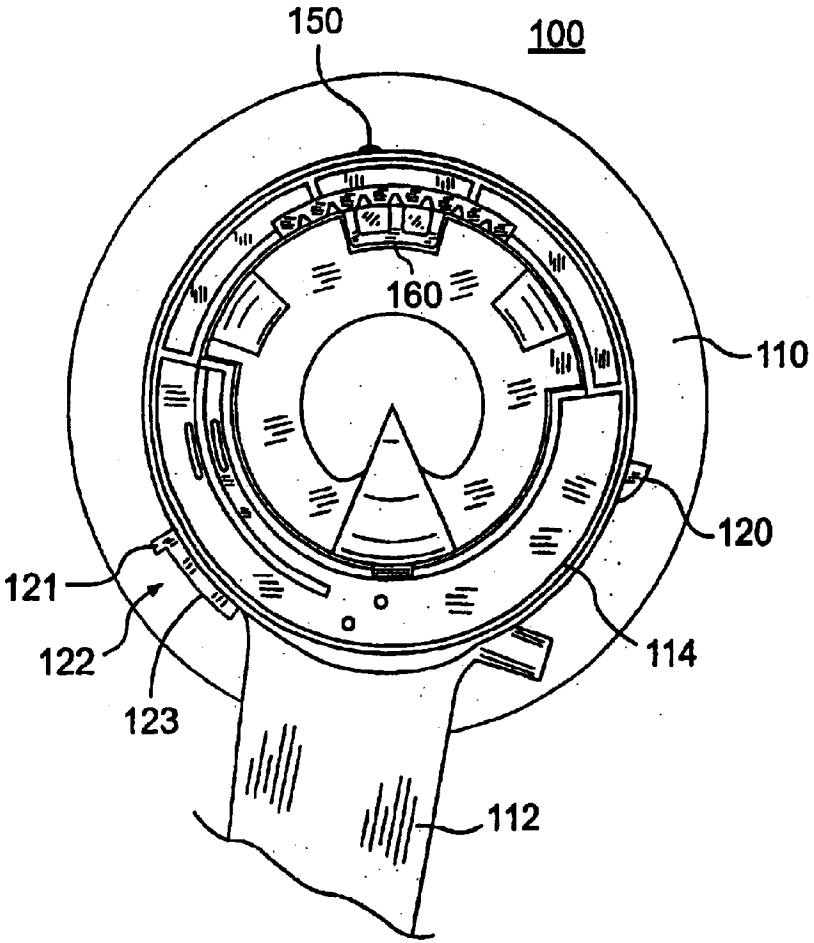
FIG. 20 is a detail view of the right-side, swing handle assembly, where the swing handle is rotated to a storage position.

Rotation of the swing handle 60 relative to the handle support structure 110 to the storage position is now described with respect to FIGS. 12, 20, and 21. FIG. 21 illustrates the swing handle 60 rotated relative to the handle support structure 110 so that the swing handle 60 is in a storage position. In the storage position, the rotational motion of the swing handle 60 relative to the handle support structure 110 need not be stopped, locked, or frictionally resisted by structures on the swing handle 60 and/or handle support structure 110, because the relative rotation is prevented by nesting of the swing handle 60 between the seat back 22 and the seat bottom 24 of the seat 20. The swing handle 60 may be nested between the seat back 22 and the seat bottom 24 of the seat 20, when the swing is in a folded position.

According to one embodiment of the invention illustrated in FIG. 12, the handle 60 and handle support structure 110 include structure to allow the handle 60 to be snapped onto the handle support structure 110, and thereafter the handle 60 is rotationally fixed to the handle support structure 110. In this regard, the outer peripheral wall 166 of the handle support structure 110 includes a snap finger 180. When the handle 60 is assembled to the handle support structure 110 such that the inner peripheral wall 164 of the support interface section 114 passes over and past the snap finger 180, the snap finger 180 extends radially outward and beyond a lip 182 of the inner peripheral wall 164. This extension of the snap finger 180 beyond the lip 182 prevents the handle 60 from being slid off of the handle support structure 110.

Figure 18:
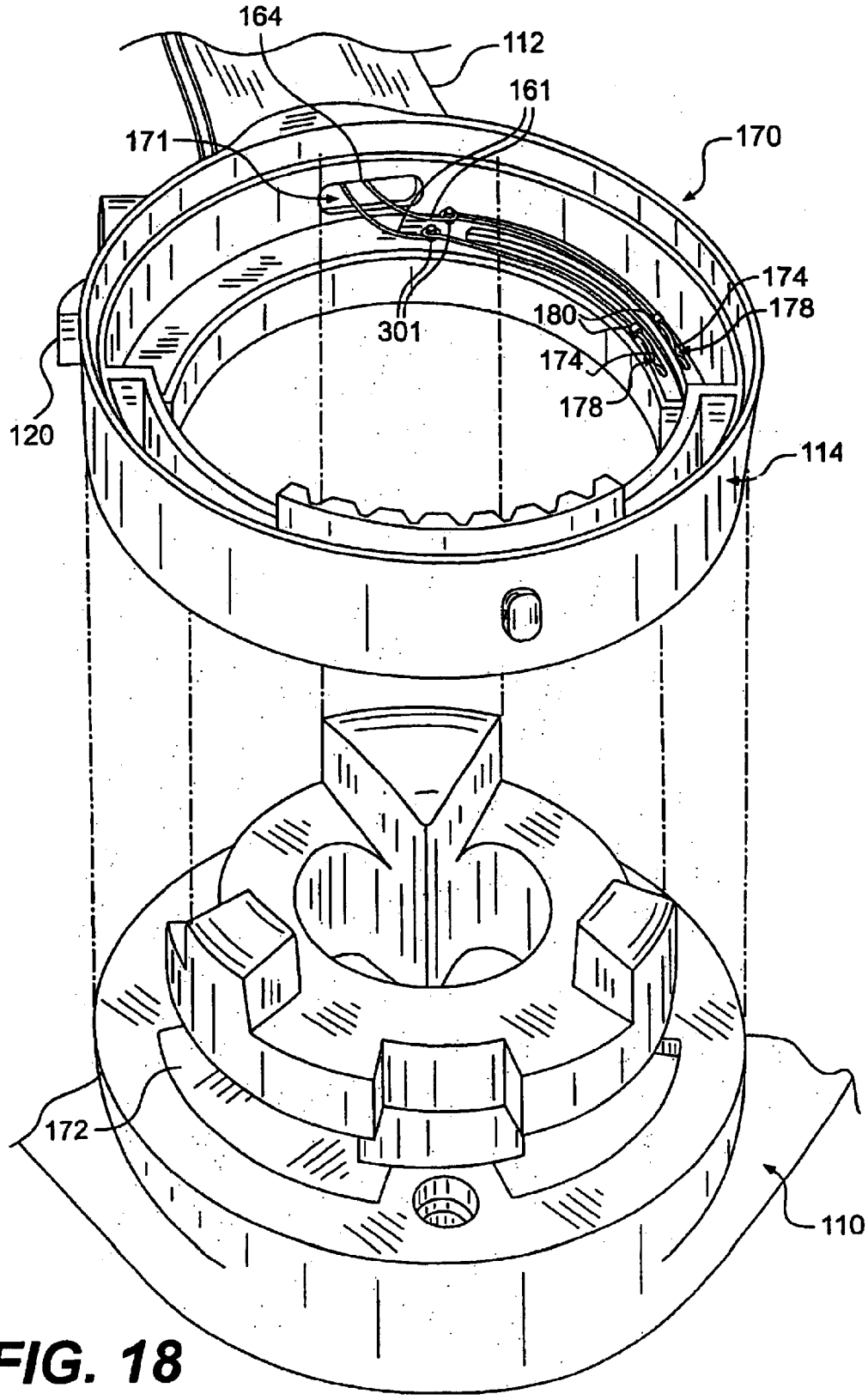
FIG. 18 is an exploded, detail view of a swing handle assembly including a moving contact assembly in accordance with the invention.
Figure 19:
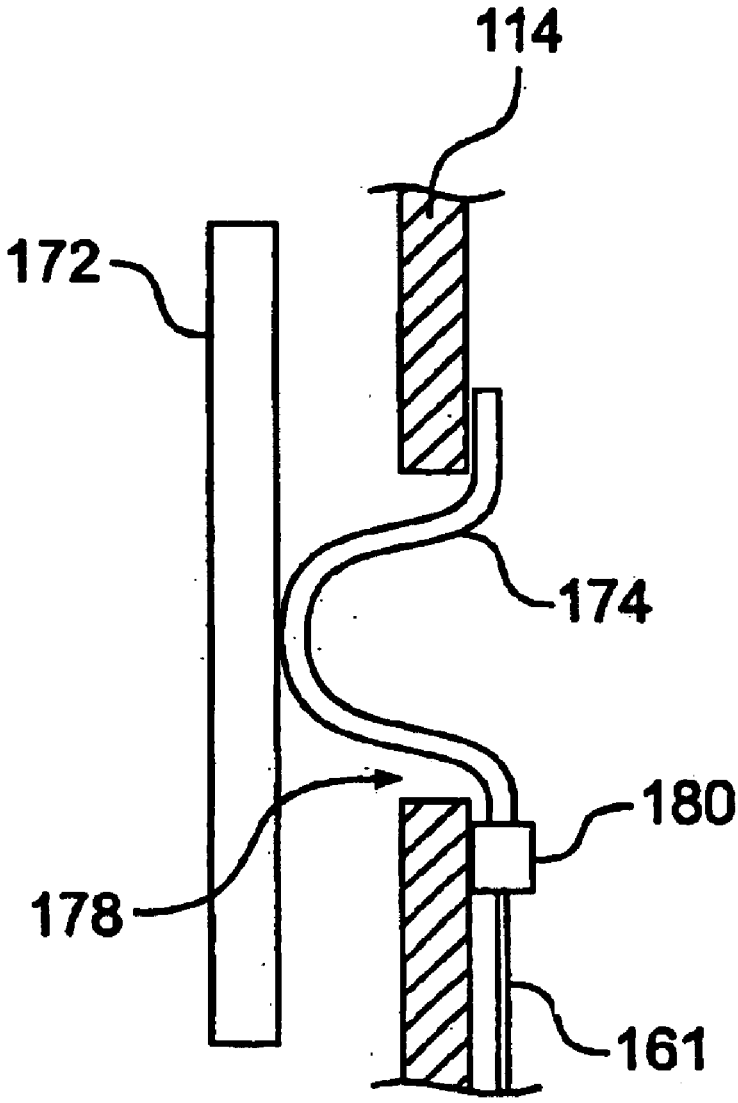
FIG. 19 is a side view of a spring contact and an arc shaped contact according to an embodiment of the invention.

FIGS. 18 and 19 illustrate another aspect of the invention wherein electrical wiring 161 extends from the handle portion 112 of the swing handle 60 into and through the support structure 110 so that electronic devices 162 (see FIG. 1) on the handle portion 112 may be powered by a power supply not in the handle portion 112, but in one of the housings 50.

The wiring 161 extends into a cavity 164 within the handle portion 112 to the electronic devices 162 on the handle portion 112. The electronic devices may be, for example, light producing electronic devices and/or sound producing electronic devices. For example, if the electronic devices 162 are for the entertainment of a child in the swing, one or more of the electronic devices 162 may be a colored light shaped as a pleasing design for a child, such as a star or a cat. The electronic devices 162 may also produce sounds instead of, or in addition to, light. For example, if the electronic device is a colored light shaped as a cat, the device may also produce a "meow" sound. One or more of the electronic devices 162 may also produce sounds such as music, for example.

The support interface portion 114 may include an outer peripheral wall 170 adjacent the handle portion 112. In order to pass the wiring 161 from the cavity 164 of the handle portion 112 to the support interface portion 114 of the handle 60, the outer peripheral wall 170 may include a slot 171. The slot 171 allows for an electrical connection between the handle portion 112 and the interface portion 114. An electrical connection or contact between the support interface portion 114 and the handle support structure 110 may be implemented by means of at least one moving contact assembly.

Beneficially the moving contact assembly allows electronics to be powered in a movable handle, i.e., the handle 60, through wiring passing through a rotating joint, i.e., the joint of the support interface portion 114 and the handle support structure 110.

The moving contact assembly may comprise a generally arc shaped contact 172 on the handle support structure 110 and at least one spring contact 174 on the support interface portion 114. The spring contacts 174 are adapted to electrically contact the generally arc shaped contact 172 as the swing handle 60 rotates relative to the handle support structure 110.

The generally arc shaped contact 172 may comprise a printed circuit board or conductive ink formed on a surface of the handle support structure 110, for example. If the generally arc shaped contact 172 comprises a printed circuit board, the handle support structure 110 may comprise a board mounting slot, so that the printed circuit board may be fixedly attached to the handle support structure 110 via the board mounting slot by snapping into the slot. Alternately the printed circuit board may be fixedly attached to the handle support structure 110 by screws or glue. The wiring 160 electrically contacts the generally arc shaped contact 172 via spring contacts 174.

The spring contacts 174 may be formed of any appropriate material, and may be, for example, formed of a sheet metal stamping, conductive plastic, or graphite, for example.

The spring contacts 174 may pass through respective slots of the at least one slot 178 on the support interface portion 114. The wiring 161 may we attached to the support interface portion 114 by wrapping the wiring 161 around respective support posts 301. The spring contacts 174 may be attached to the wiring 161 using a contact snap 180 attached to the support interface portion 114. Power supply wiring (not shown) may then extend from the generally arc shaped contact 172 to the power supply 52 (shown in FIG. 1).

The moving contact assembly comprising the generally arc shaped contact 172 and the spring contacts 174 provides an electrical contact between the generally arc shaped contact 172 and the spring contacts 174 as the swing handle 60 is rotated relative to the handle support structure 110. The arc length of the generally arc shaped contact 172 determines the rotational range over which electrical contact is maintained between the generally arc shaped contact 172 and the spring contacts 174, and thus the range over which power is supplied to the electronic devices 162. Because the electrical devices 162 may need to operate only over a limited rotational range of the handle 60, limiting the arc length of the generally arc shaped contact 172 is possible, and the limited size of the generally arc shaped contact 172 may beneficially reduce its cost. The electrical devices 162 may need to operate only over a rotational range where the swing handle 60 rotates over a certain angle forward and rearward of the entertain position, for example. In one embodiment, the position and arc length of the generally arc shaped contact 172 is configured so that the electrical devices 162 work at the lift position and at ±60 degrees from the lift position, where +60 degrees includes the entertain position.

As an alternative, the swing handle 60 itself may contain a battery support structure for containing batteries and providing power to the electronic devices 162 on the swing handle 60. In this case, the swing handle 60 need not include wiring to the power supply 52 within the housing 50.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A child swing comprising:

a frame including first and second rear legs and first and second housings; and first and second socket members connecting the first and second rear legs to the first and second housings, respectively, wherein each of the socket members receives an upper end of the respective leg, wherein each of the socket members is pivotally mounted to the respective housing to guide pivoting movement of the respective leg relative to the respective housing, and wherein the housings remain fixed during the pivoting movement of the lees relative to the respective housings.

2. A child swing according to claim 1, wherein each of the socket members is mounted to a lower, rear location of the respective housing.

3. A child swing according to claim 1, wherein each of the socket members includes a main body portion that is pivotally mounted to the respective housing and an extension, extending from the main body portion, that receives the respective leg.

4. A child swing according to claim 1, wherein each of the socket members and the respective leg are formed as a unitary construction.

5. A child swing comprising:

a frame including first and second rear legs and first and second housings; and first and second fold mechanisms pivotally connecting the first and second rear legs to the first and second housings, respectively, the fold mechanisms each including a socket member to receive an upper end of the respective leg, the socket member being pivotally mounted to the respective housing to guide pivoting movement of the respective leg relative to the respective housing, wherein the fold mechanisms each further include a release lever pivotally mounted to the socket member, and a locking pin connected to the release lever for engagement with the respective housing to facilitate positioning of the respective leg in an in-use position and in a folded position.

6. A child swing according to claim 5, wherein the release lever is mounted to the socket member to pivot together with the socket member relative to the respective housing.

7. A child swing according to claim 5, wherein the socket member includes a main body portion that is pivotally mounted to the respective housing and an extension, extending from the main body portion, that receives the respective leg.

8. A child swing according to claim 7, wherein the main body portion includes a slot through which the locking pin can extend.

9. A child swing according to claim 5, wherein the first and second housings each include a slot for receiving the respective locking pin.

10. A child swing according to claim 9, wherein the slot includes a lock area to receive the locking pin when the swing is in an in-use position, a folded detent area to receive the locking pin when the swing is in a folded position, and a travel area therebetween.

11. A child swing according to claim 10, wherein the release lever is configured to be actuated to move the locking pin from the lock area to the travel area, and wherein the release lever need not be actuated to move the locking pin from the folded detent area to the travel area.

12. A child swing according to claim 5, wherein the release lever extends beyond a perimeter of the respective housing in a direction generally along the respective leg.

13. A child swing according to claim 12, wherein the release lever extends along a front surface of an upper end of the respective rear leg.

14. A child swing comprising:

a frame including first and second front legs and first and second housings; and first and second socket members connecting the first and second front legs to the first and second housings, respectively, wherein each of the socket members receives an upper end of the respective leg, wherein each of the socket members is pivotally mounted to the respective housing to guide pivoting movement of the respective leg relative to the respective housing, and wherein the housings remain fixed in position during the pivoting movement of the lees relative to the respective housings.

15. A child swing, comprising:

a frame leg, a housing to which the frame lea is pivotally mounted; and a socket member pivotally mounted to the housing, the socket member configured to guide pivoting movement of the frame leg relative to the housing, wherein during the pivoting movement of the leg relative to the housing, the housing remains fixed in position.

16. A child swing according to claim 15, wherein the socket member is mounted to a lower, rear location of the housing.

17. A child swing according to claim 15, wherein the socket member includes a main body portion that is pivotally mounted to the housing and an extension, extending from the main body portion, that receives the frame leg.

18. A child swing according to claim 15, wherein the socket member and the frame leg are formed as a unitary construction.

19. A fold mechanism for a child swing, the child swing including a frame leg and a housing to which the frame leg is pivotally mounted by the fold mechanism, the fold mechanism comprising:

a socket member adapted to be pivotally mounted to the housing to which the frame leg is mounted, the socket member configured to guide pivoting movement of the frame leg relative to the housing;

a release lever pivotally mounted to the socket member; and a locking pin connected to the release lever for engagement with the housing to facilitate positioning of the frame leg in an in-use position and in a folded position, wherein the release lever is mounted to the leg socket member to pivot together with the leg socket member relative to the housing.

20. A fold mechanism for a child swing, the child swing including a frame leg and a housing to which the frame leg is pivotally mounted by the fold mechanism, the fold mechanism comprising:

a socket member adapted to be pivotally mounted to the housing to which the frame leg is mounted, the socket member configured to guide pivoting movement of the frame leg relative to the housing;

a release lever pivotally mounted to the socket member; and a locking pin connected to the release lever for engagement with the housing to facilitate positioning of the frame leg in an in-use position and in a folded position, wherein the release lever extends beyond a perimeter of the housing in a direction along the frame leg.

21. A child swing comprising:

a frame including first and second legs and first and second housings;

first and second socket members connecting the first and second legs to the first and second housings, respectively, wherein each of the socket members receives an upper end of the respective leg, wherein each of the socket members is movably mounted to the respective housing to guide movement of the respective leg relative to the respective housing, and wherein the housings remain fixed during the movement of the legs relative to the respective housings.

22. A child swing comprising:

a frame including first and second rear legs and first and second housings; and first and second fold mechanisms pivotally connecting the first and second rear legs to the first and second housings, respectively, the fold mechanisms each including a socket member to receive an upper end of the respective leg, the socket member being pivotally mounted to the respective housing to guide pivoting movement of the respective leg relative to the respective housing, wherein the fold mechanisms each further include a release lever pivotally mounted to the socket member.

23. A child swing according to claim 22, wherein the fold mechanisms each further include a locking pin connected to the release lever, and wherein the housings each include a slot for receiving the respective locking pin.

24. A child swing according to claim 23, wherein each slot includes a lock area to receive the respective locking pin when the swing is in an in-use position, a folded detent area to receive the respective locking pin when the swing is in a folded position, and a travel area therebetween.

25. A child swing according to claim 24, wherein the release lever is configured to be actuated to move the locking pin from the respective lock areas to the travel area, and wherein the release lever need not be actuated to move the locking pin from the folded detent area to the travel area.

26. A child swing comprising:

a frame including first and second front legs and first and second housings;

first and second fold mechanisms pivotally connecting the first and second front legs to the first and second housings, respectively, the fold mechanisms each including a socket member to receive an upper end of the respective leg, the socket member being pivotally mounted to the respective housing to guide pivoting movement of the respective leg relative to the respective housing, wherein the fold mechanisms each further include a release lever pivotally mounted to the socket member, and a locking pin connected to the release lever for engagement with the respective housing to facilitate positioning of the respective leg in an in-use position and in a folded position.

27. A child swing according to claim 26, wherein the release lever is mounted to the socket member to pivot together with the socket member relative to the respective housing.

28. A child swing according to claim 26, wherein the socket member includes a main body portion that is pivotally mounted to the respective housing and an extension, extending from the main body portion, that receives the respective leg.

29. A child swing according to claim 28, wherein the main body portion includes a slot through which the locking pin can extend.

30. A child swing according to claim 26, wherein the first and second housings each include a slot for receiving the respective locking pin.

31. A child swing according to claim 30, wherein the slot includes a lock area to receive the locking pin when the swing is in an in-use position, a folded detent area to receive the locking pin when the swing is in a folded position, and a travel area therebetween.

32. A child swing according to claim 31, wherein the release lever is configured to be actuated to move the locking pin from the lock area to the travel area, and wherein the release lever need not be actuated to move the locking pin from the folded detent area to the travel area.

33. A child swing according to claim 26, wherein the release lever extends beyond a perimeter of the respective housing in a direction generally along the respective leg.

34. A child swing according to claim 33, wherein the release lever extends along a front surface of an upper end of the respective front leg.

35. A child swing comprising:

a frame including first and second front legs and first and second housings; and first and second fold mechanisms pivotally connecting the first and second front legs to the first and second housings, respectively, the fold mechanisms each including a socket member to receive an upper end of the respective leg, the socket member being pivotally mounted to the respective housing to guide pivoting movement of the respective leg relative to the respective housing, wherein the fold mechanisms each further include a release lever pivotally mounted to the socket member.

36. A child swing according to claim 35, wherein the fold mechanisms each further include a locking pin connected to the release lever, and wherein the housings each include a slot for receiving the respective locking pin.

37. A child swing according to claim 36, wherein each slot includes a lock area to receive the respective locking pin when the swing is in an in-use position, a folded detent area to receive the respective locking pin when the swing is in a folded position, and a travel area therebetween.

38. A child swing according to claim 37, wherein the release lever is configured to be actuated to move the locking pin from the respective lock areas to the travel area, and wherein the release lever need not be actuated to move the locking pin from the folded detent area to the travel area.

* * * * *

UNITED STATES PATENT AND TRADEMARK OFFICE

CERTIFICATE OF CORRECTION

PATENT NO. : 7,052,403 B2
APPLICATION NO. : 10/702514
DATED : May 30, 2006
INVENTOR(S) : Matthew J. Ransil et al.

It is certified that error appears in the above-identified patent and that said Letters Patent is hereby corrected as shown below:

Claim 1, line 58, please delete “lees” and insert --legs--.
Claim 15, line 3, please delete “lea” and insert --leg--.

Signed and Sealed this

Twenty-second Day of August, 2006

JON W. DUDAS
*Director of the United States Patent and Trademark Office*